US011434774B2

(12) United States Patent
O'Neill et al.

(10) Patent No.: US 11,434,774 B2
(45) Date of Patent: Sep. 6, 2022

(54) BORESCOPE PLUG

(71) Applicant: United Technologies Corporation, Farmington, CT (US)

(72) Inventors: Lisa P. O'Neill, Manchester, CT (US); Amarnath Ramlogan, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 742 days.

(21) Appl. No.: 16/202,817

(22) Filed: Nov. 28, 2018

(65) Prior Publication Data

US 2019/0093491 A1 Mar. 28, 2019

Related U.S. Application Data

(63) Continuation-in-part of application No. 15/231,023, filed on Aug. 8, 2016, now Pat. No. 10,502,090.

(51) Int. Cl.
*F01D 9/04* (2006.01)
*F01D 9/00* (2006.01)
*F01D 25/24* (2006.01)

(52) U.S. Cl.
CPC ..... *F01D 9/042* (2013.01); *F01D 9/00* (2013.01); *F01D 25/243* (2013.01); *F01D 25/246* (2013.01); *F05D 2220/323* (2013.01); *F05D 2230/60* (2013.01); *F05D 2240/91* (2013.01); *F05D 2260/80* (2013.01)

(58) Field of Classification Search
CPC ..... F01D 21/003; F01D 9/041; F01D 25/24; F01D 11/003; F05D 2260/941; F05D 2260/80; F05D 2260/30; F05D 2220/32
See application file for complete search history.

(56) References Cited

U.S. PATENT DOCUMENTS 3,936,217 A * 2/1976 Travaglini ..... F01D 21/003 415/118
4,424,004 A * 1/1984 Hiskes ..... F01D 5/08 416/198 A (Continued)

FOREIGN PATENT DOCUMENTS

WO 2014171994 A2 10/2014

OTHER PUBLICATIONS

European Search Report, European Application No. 17185383.1, dated Dec. 8, 2017, European Patent Office; European Search Report 7 pages.

*Primary Examiner* — Kenneth Bomberg
*Assistant Examiner* — Adam W Brown
(74) *Attorney, Agent, or Firm* — Cantor Colburn LLP

(57) ABSTRACT

Borescope plugs are described. The borescope plugs include a borescope plug base having a first side configured to support a shank and a second side having a centroid defined as the center of the borescope plug base, a first mounting aperture formed in the second side, and a second mounting aperture formed in the second side. The first and second mounting apertures are configured to each receive a fastener to mount the borescope plug base to a case, and an offset line drawn through the center of the first mounting aperture and through the center of the second mounting aperture does not pass through the centroid or does not include a point defined by the centroid.

19 Claims, 16 Drawing Sheets

(56) References Cited

U.S. PATENT DOCUMENTS

| | | | | |
|---|---|---|---|---|
| 5,431,534 | A * | 7/1995 | Charbonnel | F01D 21/003 415/118 |
| 5,867,976 | A * | 2/1999 | Ziegler, Jr. | F01D 21/003 60/803 |
| 6,468,033 | B1 * | 10/2002 | Weidlich | F01D 17/02 415/118 |
| 9,046,003 | B2 | 6/2015 | Twell | |
| 9,574,599 | B2 * | 2/2017 | Marc | F16B 39/22 |
| 9,926,802 | B2 * | 3/2018 | Coles | G02B 23/2492 |
| 10,393,167 | B2 * | 8/2019 | Patel | G02B 23/2492 |
| 10,502,090 | B2 * | 12/2019 | Betancourt | F01D 25/24 |
| 10,618,665 | B2 * | 4/2020 | Leutard | F01D 21/003 |
| 2012/0195746 | A1 * | 8/2012 | Sarda | F04D 29/526 415/201 |
| 2018/0038241 | A1 | 2/2018 | Betancourt et al. | |

* cited by examiner

BORESCOPE PLUG

CROSS-REFERENCE TO RELATED APPLICATIONS

This application is a continuation-in-part application of the legally related U.S. Ser. No. 15/231,023, filed Aug. 8, 2016, the contents of which are incorporated by reference herein in its entirety.

BACKGROUND

The subject matter disclosed herein generally relates to gas turbine engines and, more particularly, to borescope plugs for gas turbine engines.

Borescope inspection ports can be used on gas turbine engines to enable and allow visual inspection of internal aircraft engine flowpath hardware with a fiber optic borescope. These borescope ports thereby make possible frequent critical engine inspections that otherwise could not be performed without disassembly of the aircraft engine. As such, borescope ports and attendant inspections can allow increased engine usage between overhaul and thus lowers aircraft engine operating costs. A borescope port is plugged by a borescope plug during operation of the aircraft engine. The borescope plug can be subject to high stresses at a shank of the borescope plug which can lead to decreased life of the borescope plug.

Accordingly, it may be advantageous to provide improved life borescope plugs.

SUMMARY

According to some embodiments, borescope plugs are provided. The borescope plugs include a borescope plug base having a first side configured to support a shank and a second side having a centroid defined as the center of the borescope plug base, a first mounting aperture formed in the second side, and a second mounting aperture formed in the second side. The first and second mounting apertures are configured to each receive a fastener to mount the borescope plug base to a case and an offset line drawn through the center of the first mounting aperture and through the center of the second mounting aperture does not pass through the centroid or does not include a point defined by the centroid.

In addition to one or more of the features described above, or as an alternative, further embodiments of the borescope plugs may include that the borescope plug base is at least one of square shaped, rectangular shaped, circular shaped, triangular shaped, and polygon shaped.

In addition to one or more of the features described above, or as an alternative, further embodiments of the borescope plugs may include that the offset line has an offset from the centroid being a shortest distance between the offset line and the centroid.

In addition to one or more of the features described above, or as an alternative, further embodiments of the borescope plugs may include that the offset is 1/10 inch or less (0.254 cm or less).

In addition to one or more of the features described above, or as an alternative, further embodiments of the borescope plugs may include a boss on the first side of the borescope plug.

In addition to one or more of the features described above, or as an alternative, further embodiments of the borescope plugs may include that the boss defines a base cavity.

In addition to one or more of the features described above, or as an alternative, further embodiments of the borescope plugs may include a first anti-rotation element arranged within the base cavity, the first anti-rotation element configured to be received within a second first anti-rotation element of a shank that is installed to the borescope plug base.

In addition to one or more of the features described above, or as an alternative, further embodiments of the borescope plugs may include that the first anti-rotation element is a pin.

In addition to one or more of the features described above, or as an alternative, further embodiments of the borescope plugs may include that the boss is aligned with the centroid.

In addition to one or more of the features described above, or as an alternative, further embodiments of the borescope plugs may include a shank extending from the boss.

In addition to one or more of the features described above, or as an alternative, further embodiments of the borescope plugs may include that the shank is integrally formed with the boss.

In addition to one or more of the features described above, or as an alternative, further embodiments of the borescope plugs may include that the shank includes a base engagement element at a first end of the shank and a plug member located at a second end of the shank, the plug member configured to plug a borescope aperture in a borescope vane cluster, wherein the base engagement element fits within a base cavity such that the base moveably retains the base engagement element and wherein the base engagement element can move within the base cavity.

In addition to one or more of the features described above, or as an alternative, further embodiments of the borescope plugs may include a first anti-rotation element arranged within a base cavity of the borescope plug base and a second anti-rotation element arranged as part of the base engagement element. The first anti-rotation element is configured to be received within the second anti-rotation element.

In addition to one or more of the features described above, or as an alternative, further embodiments of the borescope plugs may include that the first anti-rotation element is positioned within the base cavity relative to the shank such that the position of the first anti-rotation element is aligned with an outer surface or an outer radius of the shank.

According to some embodiments, borescope plugs are described. The borescope plugs include a borescope plug base having a first side configured to support a shank and a second side having a major axis and a minor axis passing through a center of the second side of the borescope plug base, a first mounting aperture formed in the second side, and a second mounting aperture formed in the second side. The first and second mounting apertures are configured to each receive a fastener to mount the borescope plug base to a case and the first mounting aperture is positioned an offset distance from the major axis and the first and second mounting apertures are not symmetric about the minor axis.

In addition to one or more of the features described above, or as an alternative, further embodiments of the borescope plugs may include a first anti-rotation element arranged within on the first side of the borescope plug base, the first anti-rotation element configured to be received within a second first anti-rotation element of a shank that is installed to the borescope plug base, wherein the first anti-rotation element is a pin.

In addition to one or more of the features described above, or as an alternative, further embodiments of the borescope plugs may include that the offset distance is 1/10 inch or less (0.254 cm or less).

According to some embodiments, gas turbine engines are provided. The gas turbine engines include a case having a case aperture, a borescope vane cluster installed on an inner diameter of the case proximate the case aperture and having a borescope aperture and a borescope plug. The borescope plug includes a base fixedly attached to the case and having a first side and a second side, the second side having a centroid defined as the center of the borescope plug base, a first mounting aperture formed in the second side, and a second mounting aperture formed in the second side. The first and second mounting apertures are configured to each receive a fastener to mount the borescope plug base to the case and an offset line drawn through the center of the first mounting aperture and through the center of the second mounting aperture does not pass through the centroid or does not include a point defined by the centroid.

In addition to one or more of the features described above, or as an alternative, further embodiments of the gas turbine engines may include that a boss formed on the first side of the base and a shank extending from the boss. The shank includes a base engagement element at a first end of the shank and a plug member located at a second end of the shank, the plug member configured to plug a borescope aperture in a borescope vane cluster, wherein the base engagement element fits within a base cavity such that the base moveably retains the base engagement element and wherein the base engagement element can move within the base cavity.

In addition to one or more of the features described above, or as an alternative, further embodiments of the gas turbine engines may include a first anti-rotation element arranged within the base cavity and a second anti-rotation element arranged as part of the base engagement element. The first anti-rotation element is a pin and is configured to be received within the second anti-rotation element.

The foregoing features and elements may be executed or utilized in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
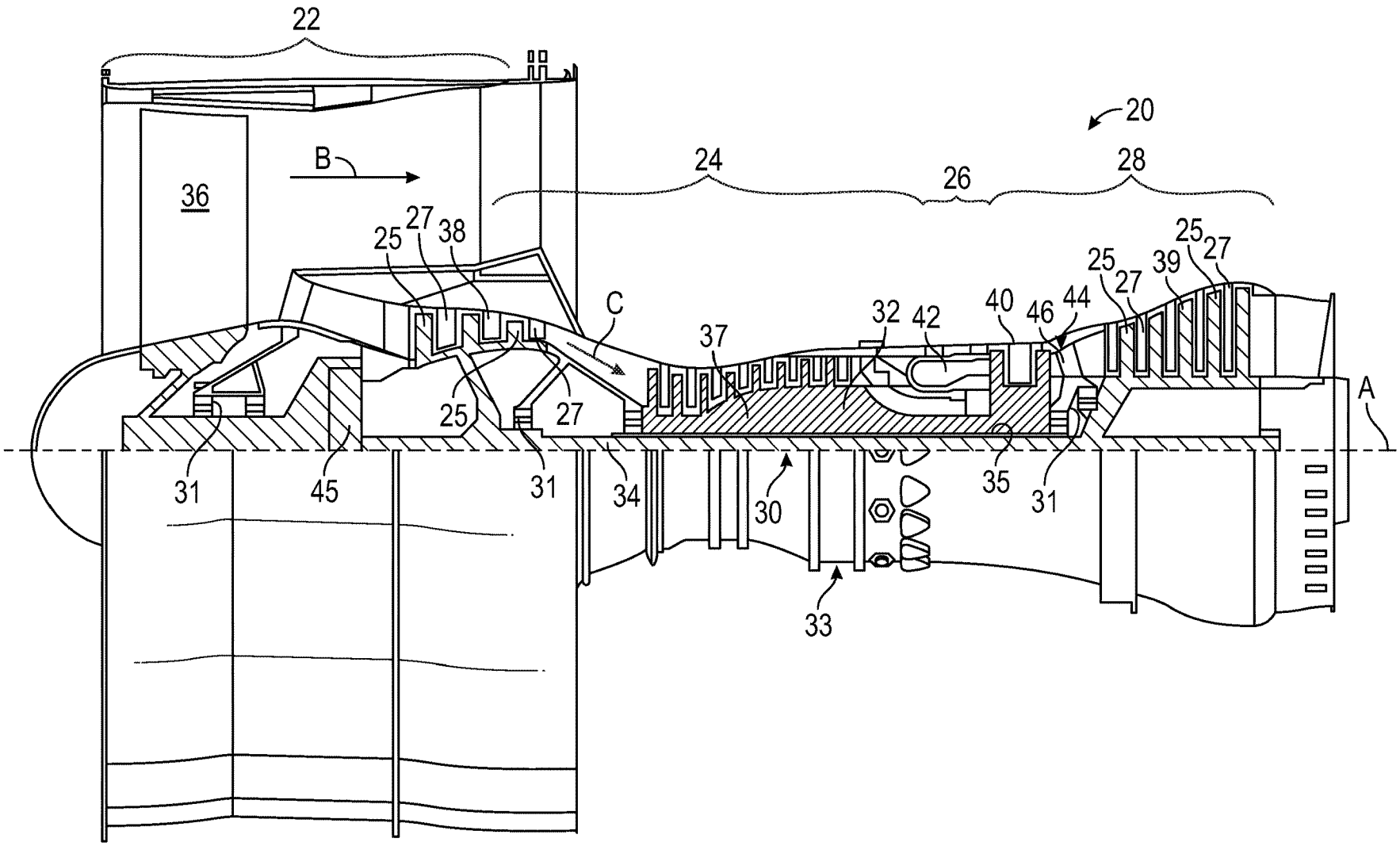
FIG. 1 is a schematic cross-sectional illustration of a gas turbine engine architecture that may employ various embodiments disclosed herein.

FIG. 1 schematically illustrates a gas turbine engine 20. The exemplary gas turbine engine 20 is a two-spool turbofan engine that generally incorporates a fan section 22, a compressor section 24, a combustor section 26, and a turbine section 28. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. A bypass ratio (BPR) of a gas turbine engine is the ratio between the mass flow rate of air drawn through the fan disk that bypasses the engine core (uncombusted air) to the mass flow rate passing through the engine core (combusted air). For example, a 10:1 bypass ratio means that 10 kg of air passes around the core for every 1 kg of air passing through the core. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies add or extract energy from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as airflow bleed ports are discussed below.

Although an example architecture for gas turbine engines is depicted (e.g., turbofan in FIG. 1) in the disclosed non-limiting embodiment, it should be understood that the concepts described herein are not limited to use with the shown and described configurations, as the teachings may be applied to other types of engines without departing from the scope of the present disclosure.

Figure 2:
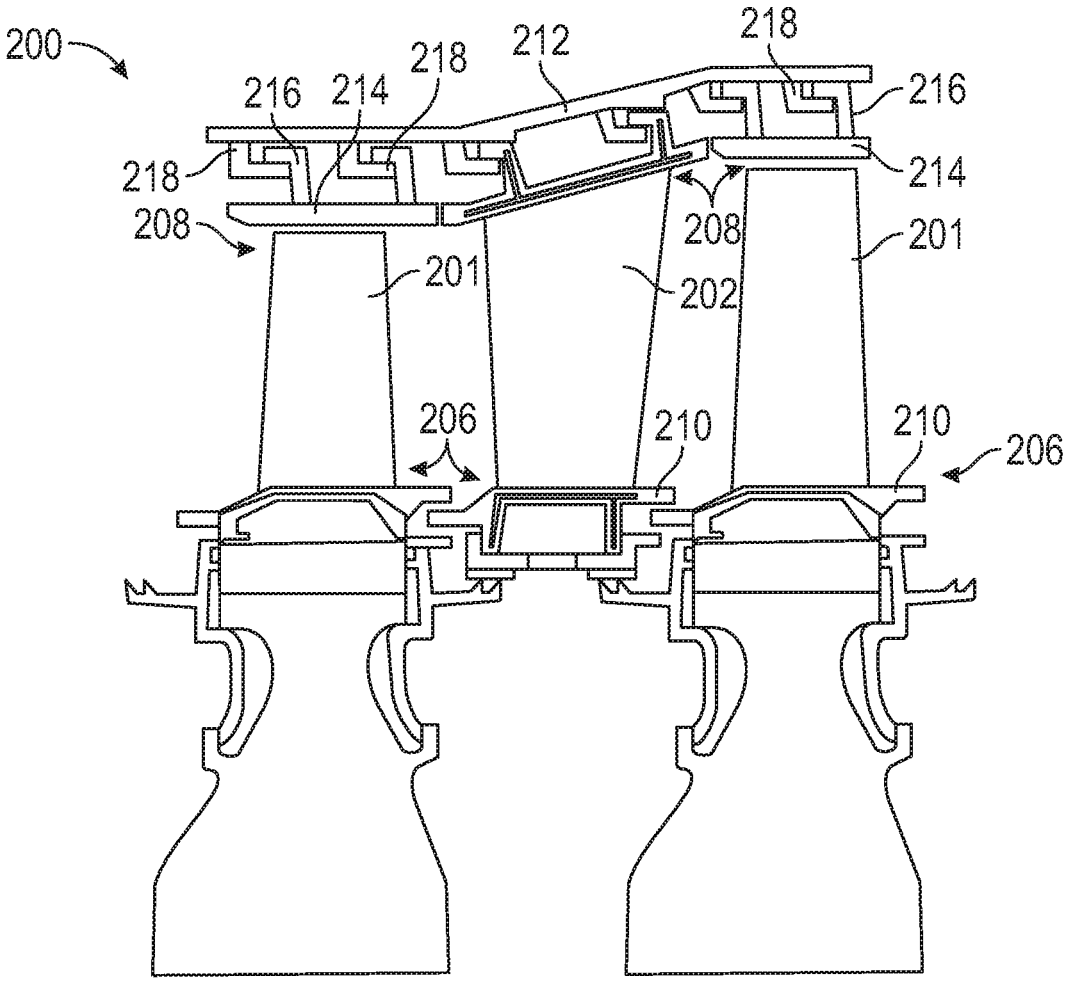
FIG. 2 is a schematic illustration of a section of a gas turbine engine that may employ various embodiments disclosed herein.

FIG. 2 is a schematic view of a turbine section that may employ various embodiments disclosed herein. Turbine 200 includes a plurality of airfoils, including, for example, one or more blades 201 and vanes 202. The airfoils 201, 202 may be hollow bodies with internal cavities defining a number of channels or cavities, hereinafter airfoil cavities, formed therein and extending from an inner diameter 206 to an outer diameter 208, or vice-versa. The airfoil cavities may be separated by partitions within the airfoils 201, 202 that may extend either from the inner diameter 206 or the outer diameter 208 of the airfoil 201, 202. The partitions may extend for a portion of the length of the airfoil 201, 202, but may stop or end prior to forming a complete wall within the airfoil 201, 202. Thus, each of the airfoil cavities may be fluidly connected and form a fluid path within the respective airfoil 201, 202. The blades 201 and the vanes 202 may include platforms 210 located proximal to the inner diameter thereof. Located below the platforms 210 may be airflow ports and/or bleed orifices that enable air to bleed from the internal cavities of the airfoils 201, 202. A root of the airfoil may connected to or be part of the platform 210.

The turbine 200 is housed within a case 212, which may have multiple parts (e.g., turbine case, diffuser case, etc.). In various locations, components, such as seals, may be positioned between airfoils 201, 202 and the case 212. For example, as shown in FIG. 2, blade outer air seals 214 (hereafter "BOAS") are located radially outward from the blades 201. As will be appreciated by those of skill in the art, the BOAS 214 can include BOAS supports that are configured to fixedly connect or attach the BOAS 214 to the case 212 (e.g., the BOAS supports can be located between the BOAS and the case). As shown in FIG. 2, the case 212 includes a plurality of hooks 218 that engage with the hooks 216 to secure the BOAS 214 between the case 212 and a tip of the blade 201.

Figure 3A:
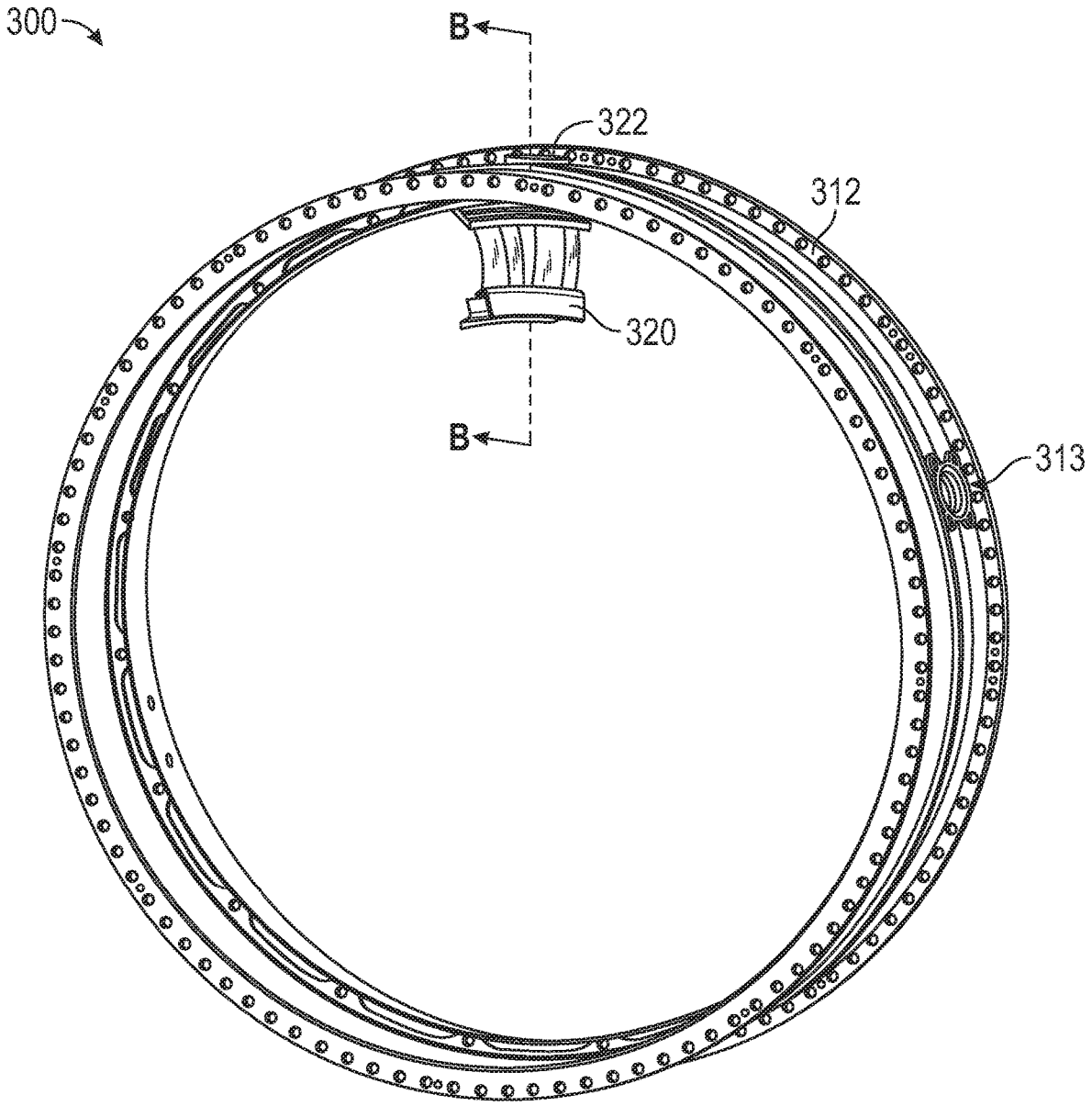
FIG. 3A is an isometric illustration of a case of a turbine having a borescope vane cluster installed on an inner diameter of the case.
Figure 3B:
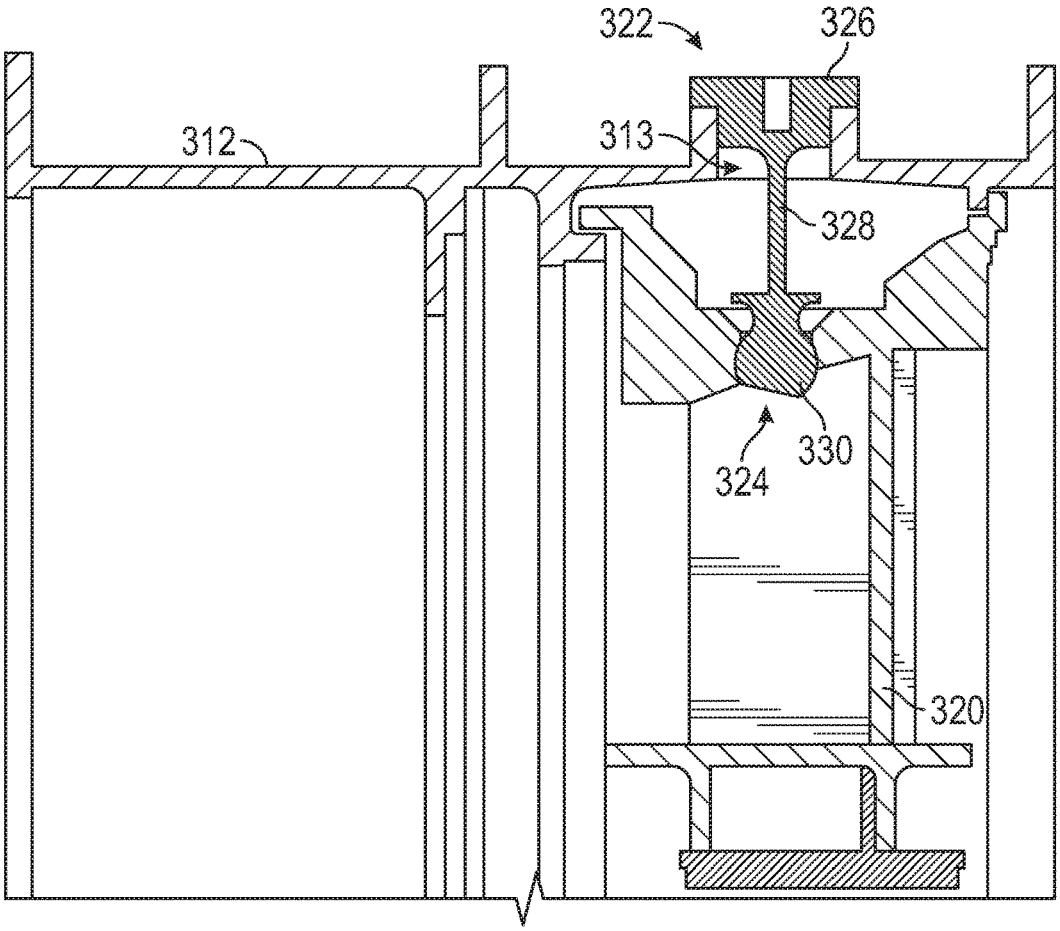
FIG. 3B is a cross-sectional illustration of the case of FIG. 3A as viewed along the line B-B of FIG. 3A.
Figure 3C:
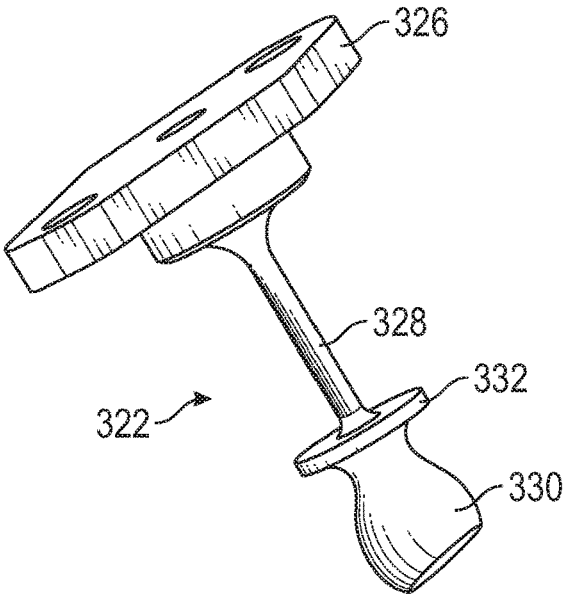
FIG. 3C is an isometric illustration of a borescope plug.

Turning now to FIGS. 3A-3C, schematic illustrations of a turbine 300 having a borescope vane cluster 320 and a borescope plug 322 are shown. FIG. 3A is a schematic illustration of the borescope vane cluster 320 installed to a case 312, with other vanes omitted for clarity. As shown in FIG. 3A, a borescope plug 322 is installed through a case aperture 313 of the case 312 and into the borescope vane cluster 320 and plugs a borescope aperture 324 of the borescope vane cluster 320.

FIG. 3B is a cross-sectional illustration of the borescope vane cluster 320 and borescope plug 322 as viewed along the line B-B of FIG. 3A. As shown, the borescope vane cluster 320 includes a borescope aperture 324 in an outer diameter of the borescope vane cluster 320. The borescope aperture 324 is designed to allow a borescope to be inserted therethrough so that inspection of the turbine 300 or portions thereof can be carried out. During operation of the turbine 300 the borescope aperture 324 is plugged with a borescope plug 322, shown in isometric view in FIG. 3C separate from the turbine 300. The borescope plug 322 includes a mounting plate or base 326, a shank 328 extending from the base 326, and a plug member 330 at an end of the shank 328. As shown, the borescope plug 322 is a unitary piece that is installed into the borescope vane cluster 320 through the case 312. The base 326 of the borescope plug 322 is fixedly attached or connected to an outer diameter of the case 312, and the shank 328 and plug member 330 extend inward such that the plug member can plug or otherwise engage with the borescope aperture 324 of the borescope vane cluster 320.

As shown in FIG. 3C, the borescope plug 322 includes a flange 332 located between the plug member 330 and the shank 328. The flange 332 is optional and can be provided to prevent the plug member 330 from falling into the borescope vane cluster 320 if the shank 328 breaks or otherwise fails such that the plug member 330 separates from the shank 328 and/or the base 326.

During operation, the borescope plug 322 can be subject to high stresses at the shank 328. The shank 328 thus can have a limiting life cycle. The embodiment shown in FIGS. 3A-3C of the borescope plug 320 does not allow movement of the shank 328 and plug member 330 relative to the base 326. Because the position of the shank 328 is fixed relative to the base 326, some of the loads experienced by the vanes of the borescope vane cluster 320 can be transferred to the shank 328, which can result in decreased life of the borescope plug 322. For example, turbine stator (vane) loads from gas-path forces, vibration, and thermal gradient between the stator and the outer mounting case can be transmitted from the plug member 330 to the base 326 of the borescope plug 322 through the shank 328.

Figure 4A:
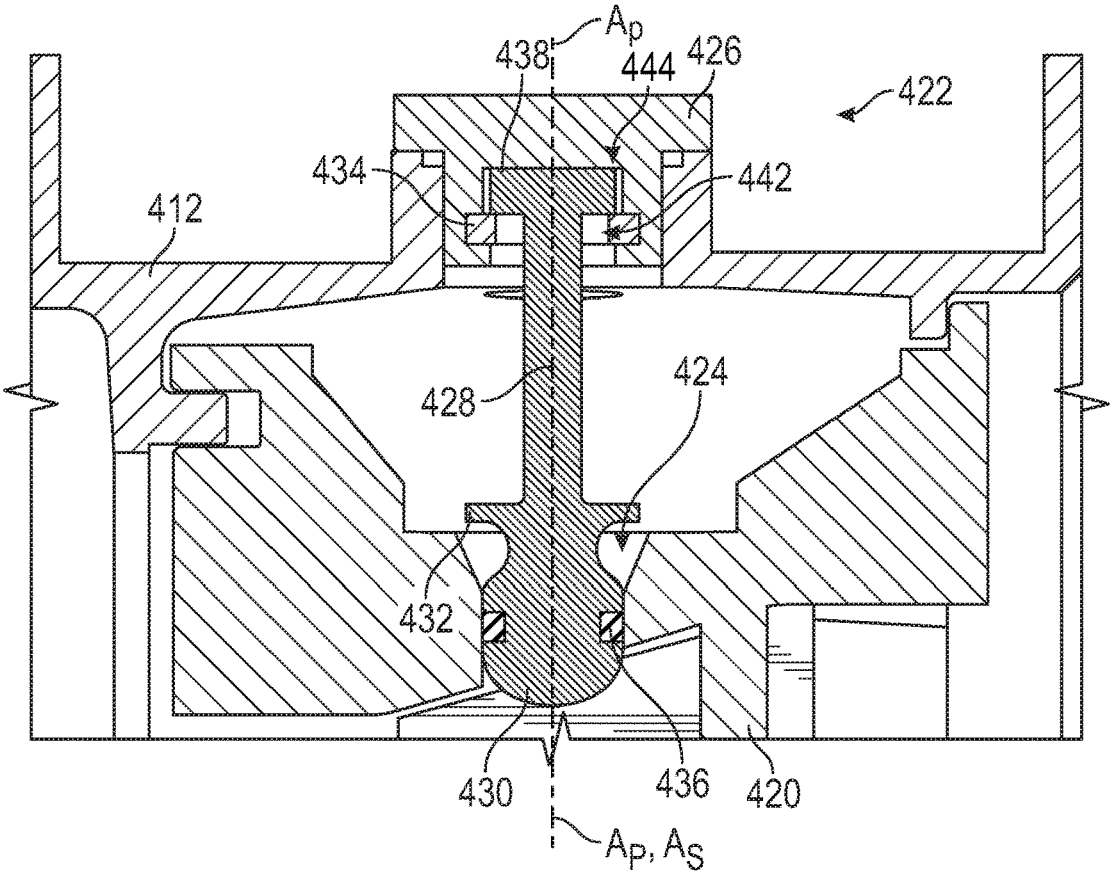
FIG. 4A is a cross-sectional illustration of a borescope plug in accordance with an embodiment of the present disclosure.
Figure 4B:
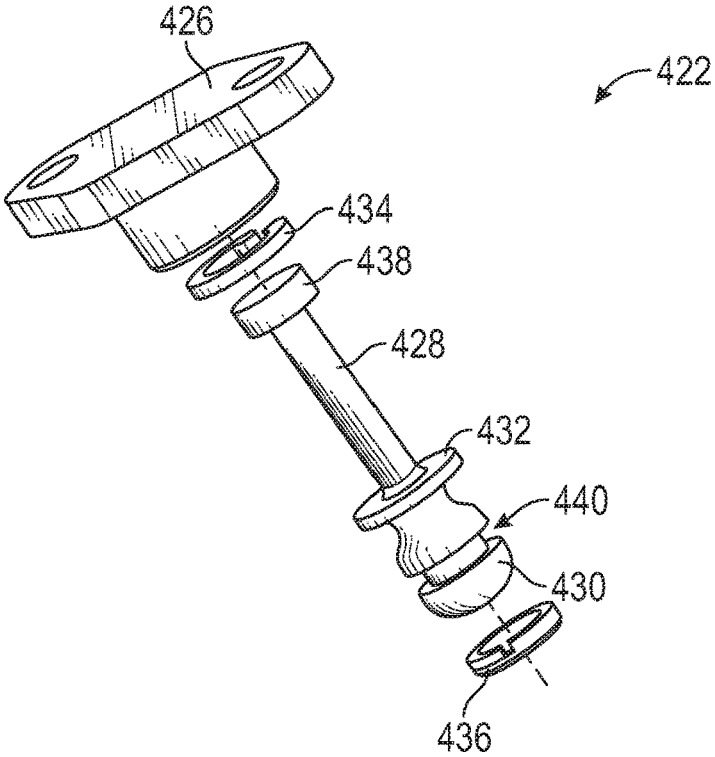
FIG. 4B is an exploded, isometric illustration of the borescope plug of FIG. 4A.

Turning now to FIGS. 4A-4B, an example non-limiting embodiment of a borescope plug 422 in accordance with the present disclosure is shown. FIG. 4A is a cross-sectional illustration of the borescope plug 422 as installed into a case 412 and plugging or engaged with and into a borescope aperture 424 of a borescope vane cluster 420. FIG. 4B is an exploded isometric illustration of the borescope plug 422.

As shown, the borescope plug 422 includes a base 426, a shank 428, and a plug member 430. However, in contrast to the embodiment shown in FIGS. 3A-3C, the borescope plug 422 of FIGS. 4A-4B separates the base 426 and the shank 428. Accordingly, the shank 428, and thus the plug member 430, can move relative to the base 426. The base 426 is fixedly attached or otherwise connected to the case 412 and the plug member 430 and shank 428 can move relative thereto.

As shown in FIGS. 4A-4B, the borescope plug 422 includes the base 426, a retainer 434, the shank 428 having the plug member 430 on an end opposite the base 426, and a seal 436. The shank 428 has a base engagement element 438 at a first end of the shank 428 and the plug member 430 is at a second (opposite) end of the shank 428. The shank 428 further includes an optional flange 432, similar to that described above, located at the second end of the shank 428 between the shank 428 and the plug member 430. The plug member 430, as shown, includes an optional seal recess 440 that is configured to receive the seal 436. The seal 436 is configured to provide sealing engagement between the plug member 430 and the walls of the borescope aperture 424 that passes through an outer diameter of the borescope vane cluster 420.

As shown, the retainer 434 fits around a portion of the shank 428 and keeps the shank 428 and the base 426 together while allowing the shank 428 and plug member 430 to rotate about a plug axis $A_p$. The retainer 434 has a retainer aperture 442 that is wide enough to enable the shank 428 to pass therethrough and also enable movement of the shank 428 within the retainer aperture 442. However, the retainer aperture 442 has a smaller diameter or shape than a diameter or shape of the base engagement element 438. The base engagement element 438 fits within a base cavity 444 of the base 426 that is configured to receive the base engagement element 438. The base engagement element 438 is sized to be smaller than the base cavity 444 such that the shank 428 can rotate about the shank axis $A_p$.

Furthermore, the base engagement element 438 is sized such that movement of the base engagement element 438 within the base cavity 444 is possible. Accordingly, in addition to rotational movement about the shank axis $A_p$, the base engagement element 438 is enabled to move laterally or in a plane perpendicular to the shank axis $A_p$. That is, the base engagement element 438 can translate across a plane parallel to a surface of the base 426. Because the shank 428 can rotate, the plug member 430 is modified to have a round geometry such that the same shape of the plug member 430 always extends into a flow path of the borescope vane cluster 420 and the seal 436 prevents gas path air ingestion through the borescope aperture 424.

In some embodiments, the shape of the base of embodiments of the present disclosure may not be flat (e.g., as shown in the figures). That is, in some embodiments, the base may have a curved or other shape or contour such that the base does not define a plane. However, the base cavity in various embodiments can be sized and shaped to receive a base engagement element and allow for movement of the base engagement element within the base cavity. Thus, the illustrations presented herein are merely for illustrative and explanatory purposes and are not intended to be limiting.

Figure 5A:
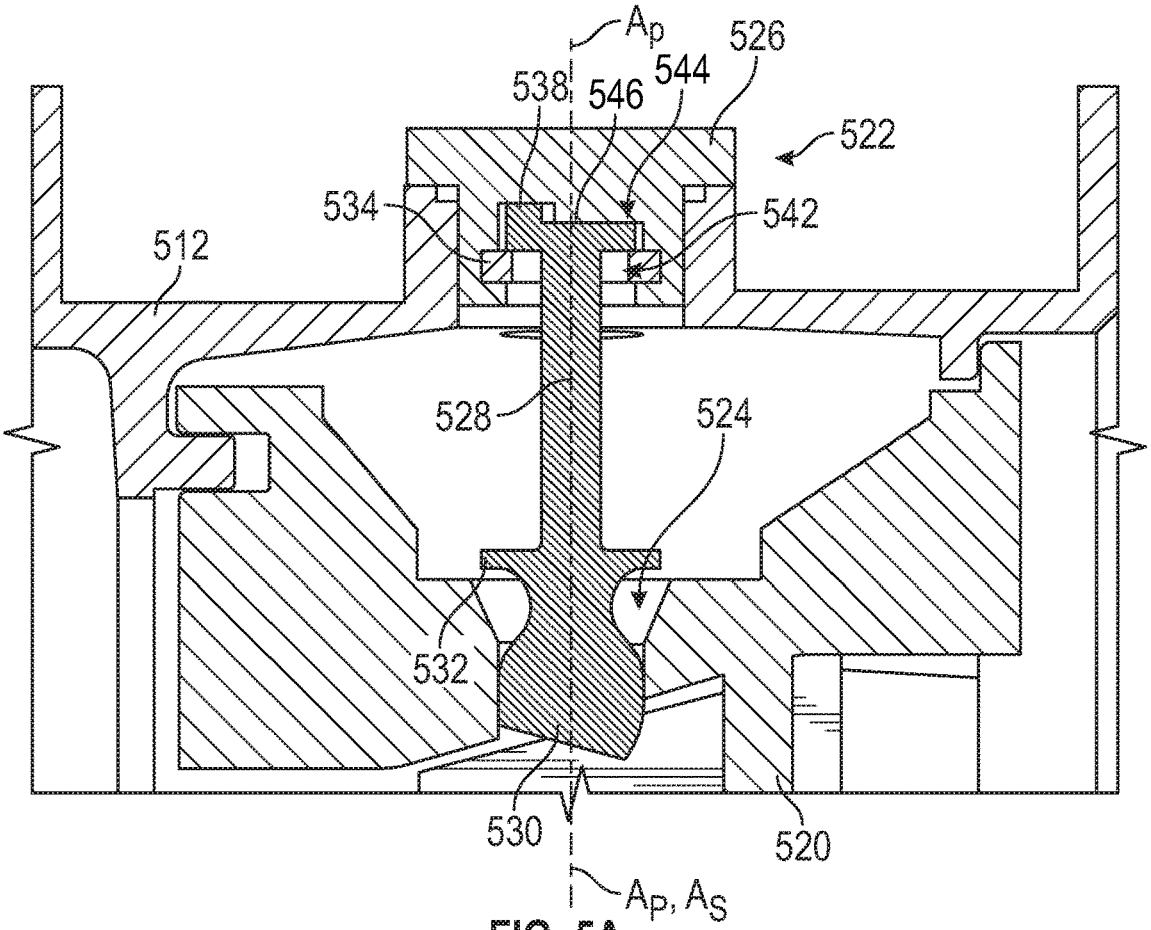
FIG. 5A is a cross-sectional illustration of a borescope plug in accordance with an embodiment of the present disclosure.
Figure 5B:
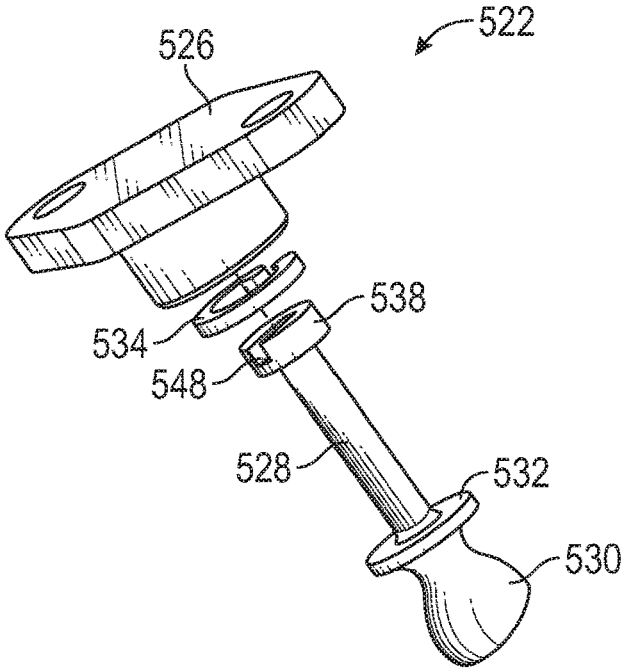
FIG. 5B is an exploded, isometric illustration of the borescope plug of FIG. 5A.
Figure 5C:
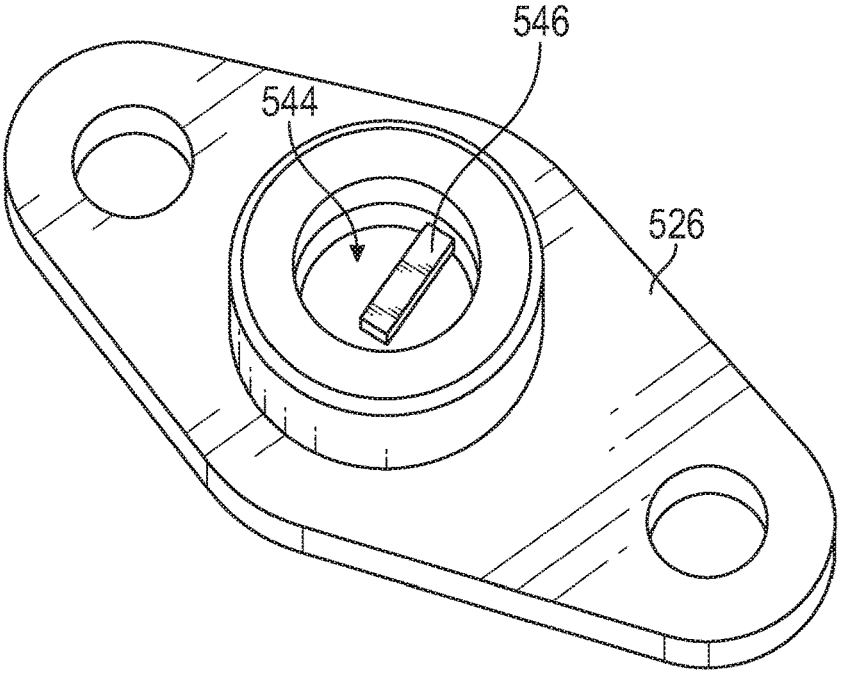
FIG. 5C is an isometric illustration of a base of the borescope plug of FIG. 5A.
Figure 5D:
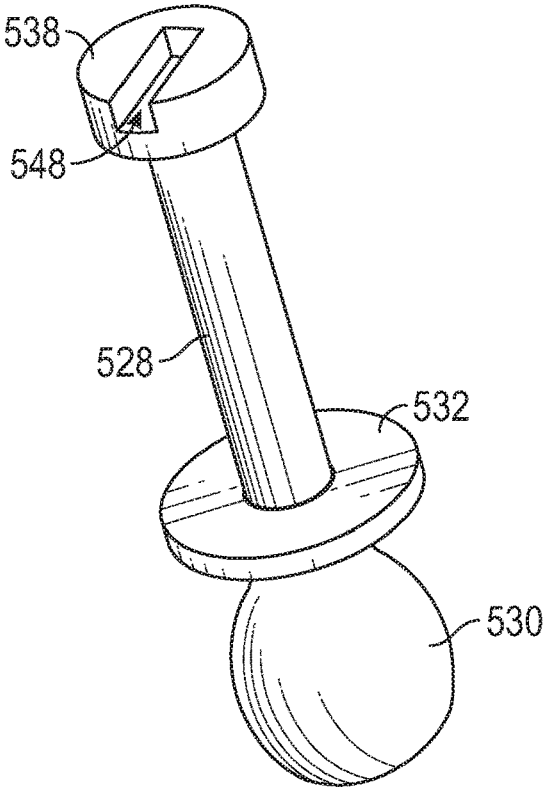
FIG. 5D is an isometric illustration of a shank of the borescope plug of FIG. 5A.

Turning now to FIGS. 5A-5D, another non-limiting embodiment of a borescope plug in accordance with the present disclosure is shown. FIG. 5A is a cross-sectional illustration of a borescope plug 522 as installed into a case 512 and plugging or engaged with and into a borescope aperture 524 of a borescope vane cluster 520. FIG. 5B is an exploded isometric illustration of the borescope plug 522. FIG. 5C is an isometric illustration of a base 526 of the borescope plug 522 and FIG. 5D is an isometric illustration of a base engagement element 538, shank 528, and plug member 530 of the borescope plug 522.

Similar to that shown in FIGS. 4A-4B, the borescope plug 522 includes a base engagement element 538 that engages within a base cavity 544 of the base 526. A retainer 534 is configured to retain the shank 528 and plug member 530 to the base 526. The borescope plug 522 further includes an optional flange 532, as described above.

As described with respect to FIGS. 4A-4B, the shank 428 and plug member 430 as rotatable about the shank axis $A_s$, with the shank axis $A_s$ being the same as the plug axis $A_p$.

In contrast, the shank 528 and plug member 530 of the embodiment of FIGS. 5A-5D is prevented from rotation about the shank axis $A_s$. However, the base engagement element 538 is permitted to move within the base cavity 544.

As shown in FIGS. 5C-5D, anti-rotation elements are provided in the engagement between the base engagement element 538 and the base 526. The base includes a first anti-rotation element 546 and the base engagement element 538 includes a second anti-rotation element 548. The anti-rotation elements 546, 548 are configured to operate together to prevent rotation of the shank 528 relative to the base 526. As shown, the first anti-rotation element 546 on the base 526 is located within the base cavity 544 and is formed as a protrusion. The second anti-rotation element 548 of the base engagement element 538, as shown, is a recess that is sized and shaped to receive the first anti-rotation element 546. Although shown with a protrusion on the base and a recess on the base engagement element, those of skill in the art will appreciate that the opposite may be employed without departing from the scope of the present disclosure. Furthermore, although shown as a slot and protrusion configuration, those of skill in the art will appreciate that any shape, size, and/or geometry of one or both of the first and second anti-rotation elements can be employed without departing from the scope of the present disclosure. In some embodiments, the anti-rotation elements can comprise a pin or other structure, as described below, which is fixed relative to the base and set offset from an axis or centerline of the shank in order to prevent and/or control rotation of the shank relative to the base.

In the embodiment of FIGS. 5A-5D, although rotation about the shank axis $A_s$ is prevented, the base engagement element 538 is enabled to move within the base cavity 544. For example, movement within a plane that is parallel to a surface or face of the base 526 and/or perpendicular to the shank axis $A_s$ can be enabled. Thus, for example, lateral movement of the base engagement element 538 within the base cavity 544 is possible while rotation of the shank 528 is prevented.

Figure 6A:
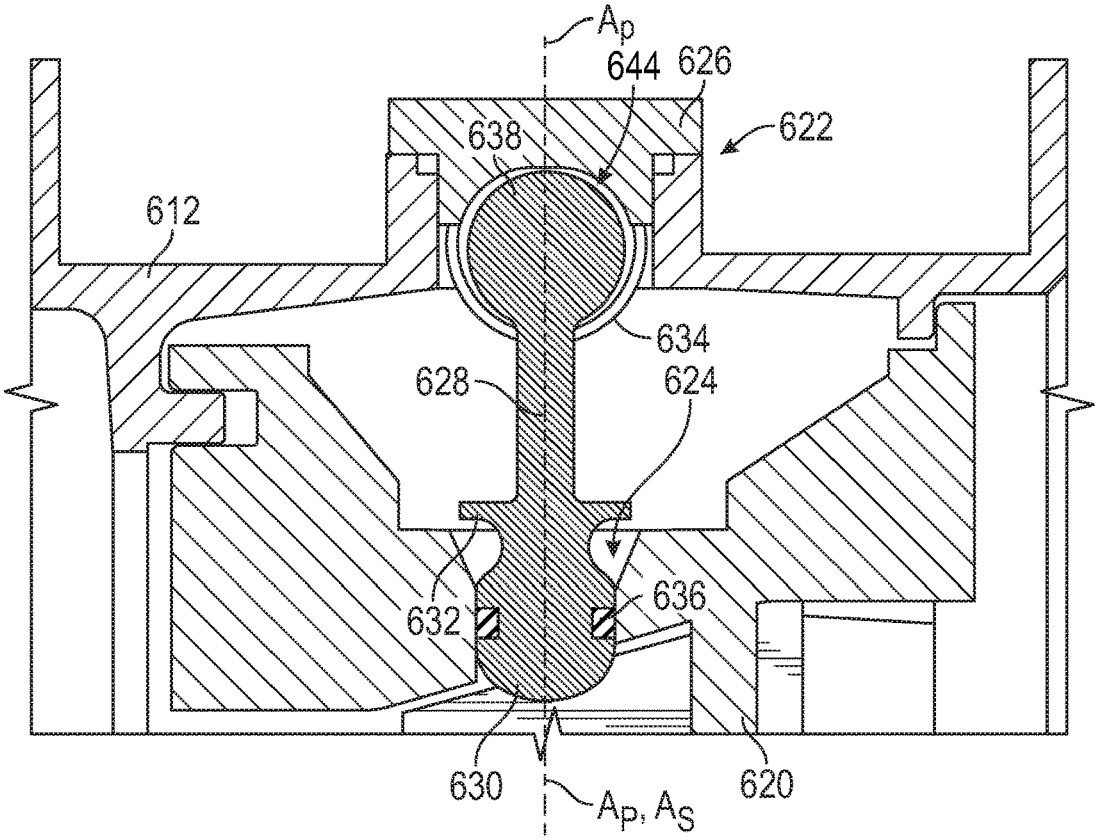
FIG. 6A is a cross-sectional illustration of a borescope plug in accordance with an embodiment of the present disclosure.
Figure 6B:
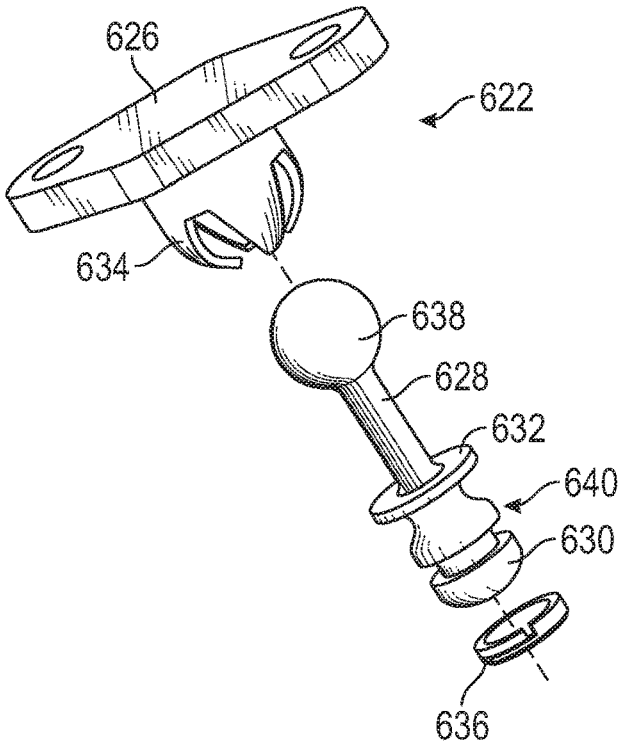
FIG. 6B is an exploded, isometric illustration of the borescope plug of FIG. 6A.
Figure 6C:
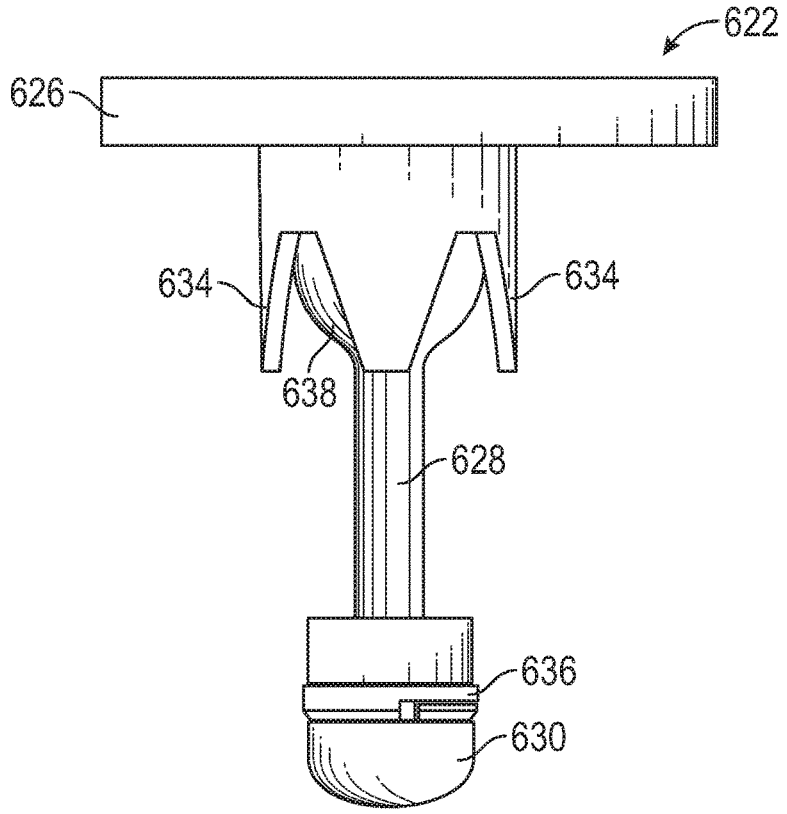
FIG. 6C is a side elevation illustration of the borescope plug of FIG. 6A in a first, open state.
Figure 6D:
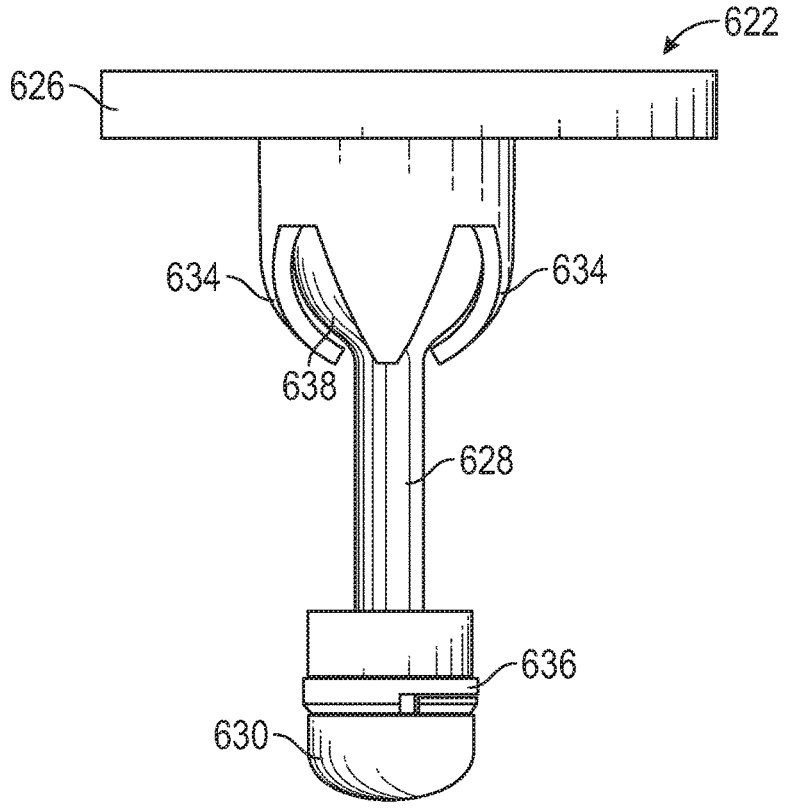
FIG. 6D is a side elevation illustration of the borescope plug of FIG. 6A in a second, closed state.

Turning now to FIGS. 6A-6D, another example non-limiting embodiment of a borescope plug 622 in accordance with the present disclosure is shown. FIG. 6A is a cross-sectional illustration of the borescope plug 622 as installed into a case 612 and plugging or engaged with and into a borescope aperture 624 of a borescope vane cluster 620. FIG. 6B is an exploded isometric illustration of the borescope plug 622. FIG. 6C is an illustration of the borescope plug 622 in a first state (e.g., open) and FIG. 6D is an illustration of the borescope plug 622 in a second state (e.g., closed).

As shown, the borescope plug 622 includes a base 626, a shank 628, and a plug member 630. As shown, the base 626 and the shank 628 are separate components. Accordingly, the shank 628, and thus the plug member 630, can move relative to the base 626. The base 626 is fixedly attached or otherwise connected to the case 612 and the plug member 630 and shank 628 can move relative thereto.

As shown in FIGS. 6A-6D, the borescope plug 622 includes the base 626, the shank 628 having the plug member 630 on an end opposite the base 626, and a seal 636. In contrast to the previously described embodiments, the retainer 634 is integrated into the base 626, and is not a separate element as shown in the prior embodiments.

The shank 628 has a base engagement element 638 at a first end of the shank 628 and the plug member 630 is at a second (opposite) end of the shank 628. The shank 628 further includes an optional flange 632 (shown in FIG. 6B, and omitted in FIGS. 6C-6D), similar to that described above, located at the second end of the shank 628 between the shank 628 and the plug member 630. The plug member 630, as shown, includes an optional seal recess 640 that is configured to receive the seal 636. The seal 636 is configured to provide sealing engagement between the plug member 630 and the walls of the borescope aperture 624 that passes through an outer diameter of the borescope vane cluster 620.

As shown, the integral retainer 634 defines the base cavity 644 fits around a portion of the shank 628 and keeps the shank 628 and the base 626 together while allowing the shank 628 and plug member 630 to rotate about a plug axis $A_p$. The retainer 634, as shown, includes crimping features or fingers that can be open to receive the base engagement element 638 of the shank 628 and then close about the base engagement element 638 to secure the shank 628 to the base 626. The integral retainer 634 is configured to enable movement of the base engagement element 638, and thus the shank 628, within the integral retainer 634. The base engagement element 438 is sized to be smaller than the base cavity 644 of the integral retainer 634 such that the shank 628 can rotate about the shank axis $A_s$.

Furthermore, the base engagement element 638 is sized such that movement of the base engagement element 638 within the base cavity 644 is possible. That is, for example, in addition to rotational movement about the shank axis $A_s$, the base engagement element 638 is enabled to move in a plane perpendicular to the shank axis $A_s$. Stated another way, the base engagement element 638 can translate across a plane parallel to a surface of the base 626. Because the shank 628 can rotate, the plug member 630 is modified to have a round geometry such that the same shape of the plug member 630 always extends into a flow path of the borescope vane cluster 620 and the seal 636 prevents gas path air ingestion through the borescope aperture 624.

Figure 7A:
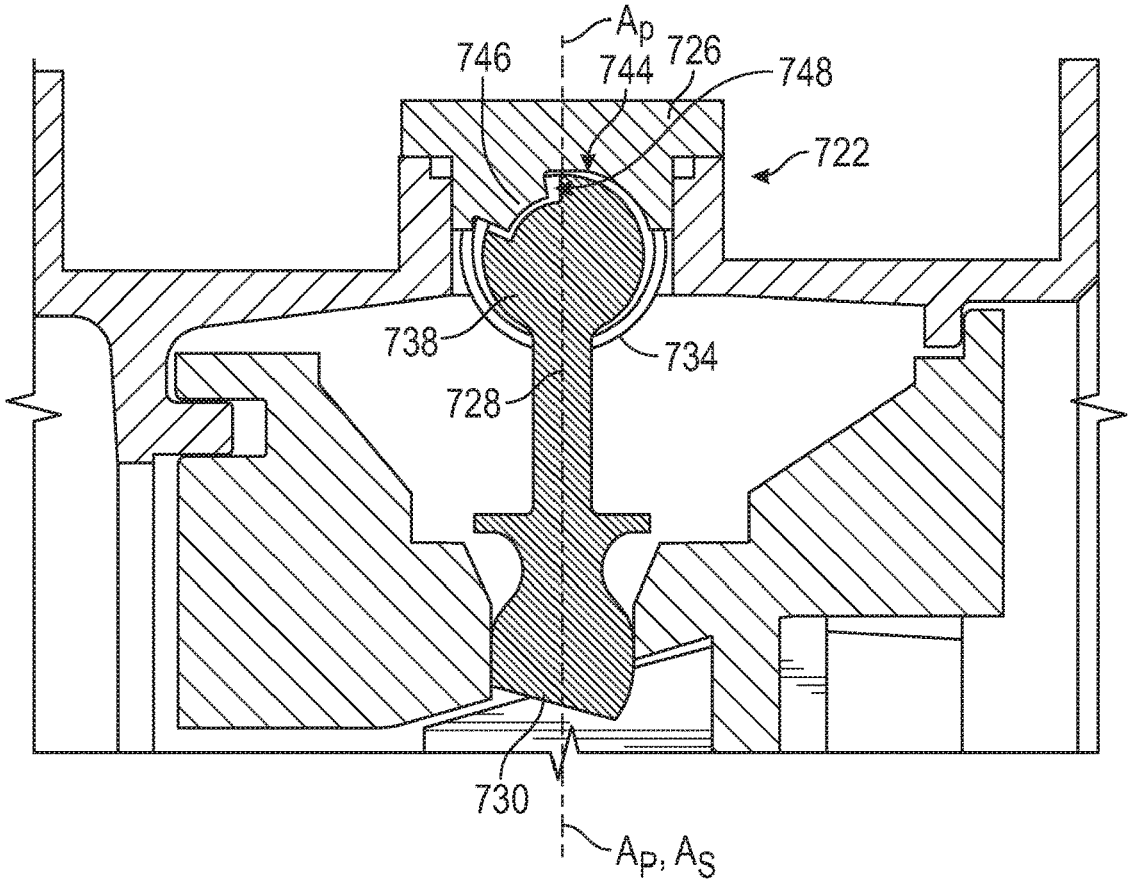
FIG. 7A is a cross-sectional illustration of a borescope plug in accordance with an embodiment of the present disclosure.
Figure 7B:
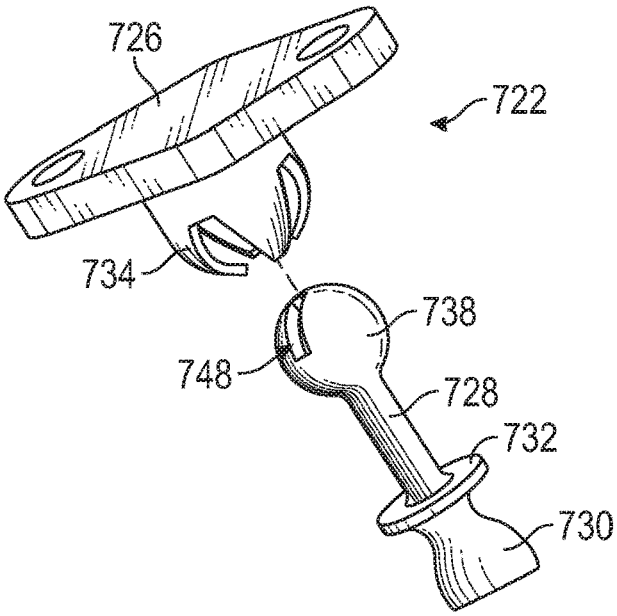
FIG. 7B is an exploded, isometric illustration of the borescope plug of FIG. 7A.
Figure 7C:
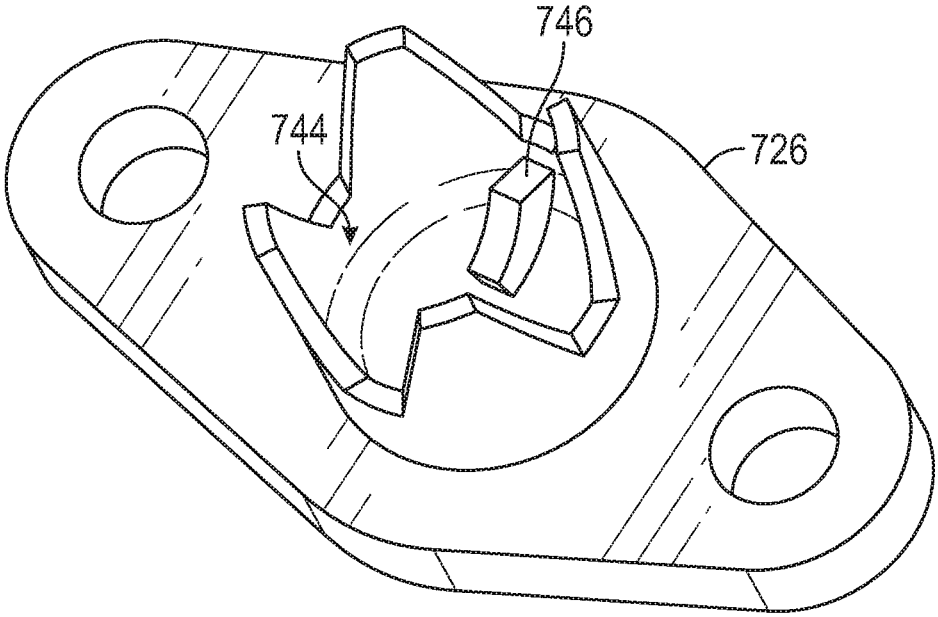
FIG. 7C is an isometric illustration of a base of the borescope plug of FIG. 7A.
Figure 7D:
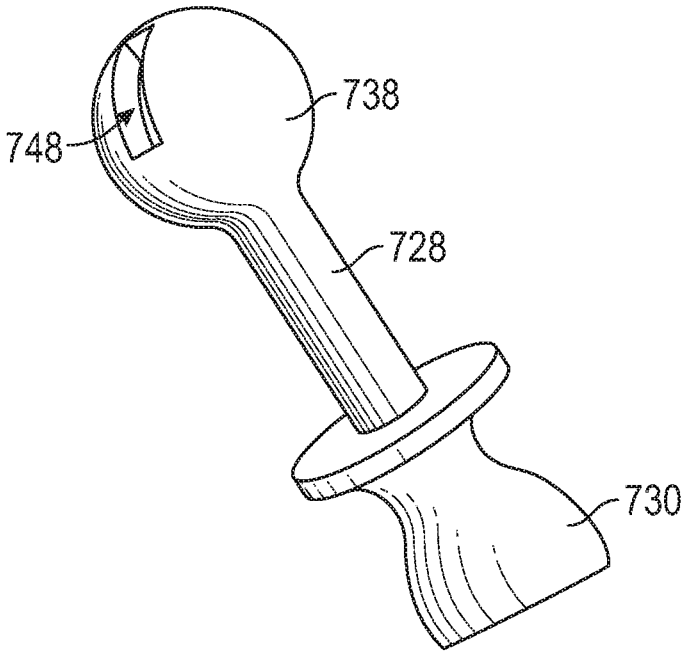
FIG. 7D is an isometric illustration of a shank of the borescope plug of FIG. 7A.

Turning now to FIGS. 7A-7D, another embodiment of the present disclosure is shown. FIG. 7A is a cross-sectional illustration of a borescope plug 722 in accordance with an embodiment of the present disclosure. FIG. 7B is an exploded, isometric illustration of the borescope plug 722. FIG. 7C is an isometric illustration of a base of the borescope plug 722. FIG. 7D is an isometric illustration of a shank of the borescope plug 722.

FIGS. 7A-7D illustrate a borescope plug 722 that combines features of previously described embodiments. As shown, the borescope plug 722 includes a base 726, a shank 728, and a plug member 730. The shank 728 includes a base engagement element 738 that fits within a base cavity 744 such that the shank 728 can be movably attached to the base 726. In the embodiment of FIGS. 7A-7D, the base 726 includes a first anti-rotation element 746 within the base cavity 744 and the base engagement element 738 includes a mating or corresponding second anti-rotation element 748 such that when the base engagement element 738 is engaged within the base cavity 744 and the retainer 734 is engaged, the shank 728 is prevented from rotation about the shank axis A but lateral movement is enabled, as described above.

Figure 8B:
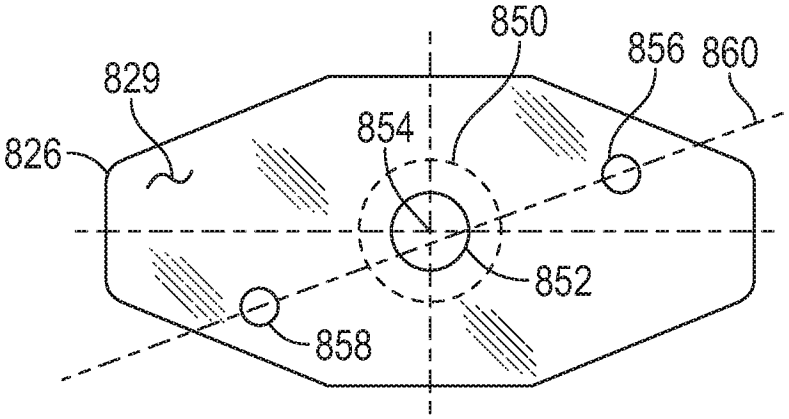
FIG. 8B is a plan view illustration viewing a surface of a base of the borescope plug of FIG. 8A.
Figure 8C:
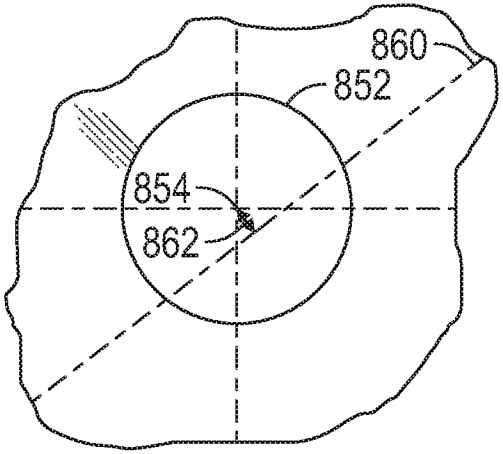
FIG. 8C is an enlarged detail of a portion of FIG. 8B.
Figure 8A:
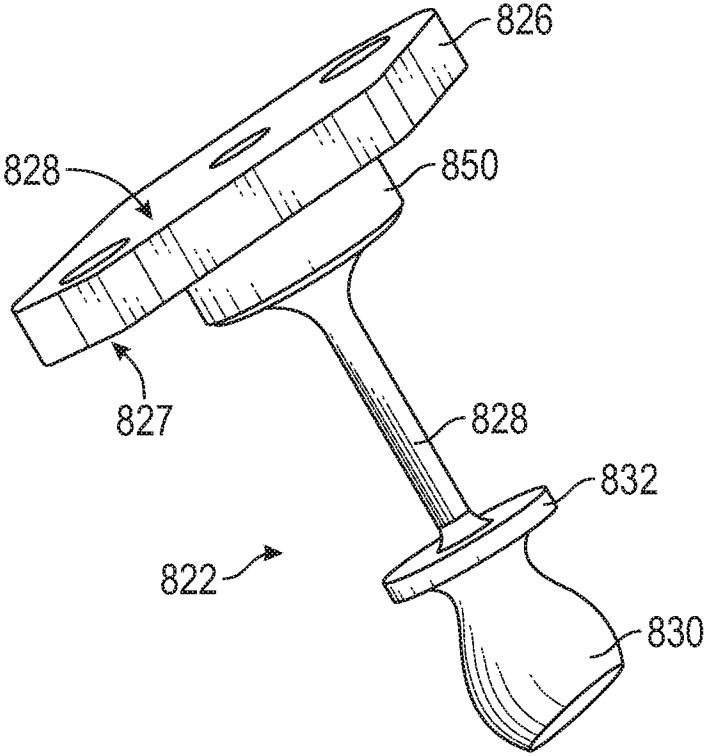
FIG. 8A is an isometric schematic illustration of a borescope plug in accordance with an embodiment of the present disclosure.

Turning now to FIGS. 8A-8C, schematic illustrations of a borescope plug 822 in accordance with an embodiment of the present disclosure are shown. FIG. 8A is an isometric schematic illustration of the borescope plug 822. FIG. 8B is a plan view illustration viewing a surface of a mounting plate or base 826 of the borescope plug 822. FIG. 8C is an enlarged detail of a portion of FIG. 8B. The borescope plug 822 may be similar to that shown and described above, having the base 826, a shank 828 extending from the base 826, and a plug member 830 at an end of the shank 828. In this embodiment, the borescope plug 822 includes a flange 832 located between the plug member 830 and the shank 828, as described above. In this illustrative embodiment, a boss 850 that is arranged between the shank 828 and the based 826. The base 826 has a first side 827 and a second side 829. The boss 850 is arranged on the first side 827 to receive the shank 828.

In some embodiments, the shank 828 may be integrally formed with the boss 850, and in some embodiments, the boss 850 may provide for a connection (fixed or releasable) between the base 826 and the shank 828, as shown and described above. That is, in some embodiments, the boss 850 may define a base cavity therein for connection with the shank 828. For example, the shank 828 may include a base engagement element that fits within the base cavity defined by the boss 850 such that the shank 828 can be movably attached to the base 826.

As shown in FIG. 8B, the base 826 includes a boss aperture 852 that may be used for connecting the boss 852 to the base 826 (e.g., by a bolt or screw). In some embodiments, such as when the boss 850 is integrally formed with the base 826, or welded thereto, the boss aperture 852 may be omitted. The boss aperture 852 is arranged at the center or centroid 854 of the base 826. The centroid 854 is the geometric center of a plane figure (e.g., the base 826) and is the arithmetic mean ("average") position of all the points in the shape. This definition extends to any object or geometry and is not limited to the geometry of the base 826 illustrated in FIG. 8B. It is noted that the centroid 854 is present with or without the boss aperture 852, and rather merely refers to the central point on the surface of the base 826.

The base 826 further includes two mounting apertures 856, 858 that are configured to enable fixed mounting of the borescope plug 822 to a case of a gas turbine engine, as shown and described above. The mounting apertures 856, 858 are formed in the second side 829 of the base 826 and may pass completely through the base 826. The mounting apertures 856, 858 may be threaded to receive and engage with a fastener to enable mounting of the base to a case of a gas turbine engine. In other embodiments, the mounting apertures 856, 858 may be smooth and allow for a fastener to pass therethrough, with the fastener engaging with a nut or other locking element that is positioned on the first side 827 of the base 826.

The position of the mounting apertures 856, 858 is set such that the base 826 can only be installed into and attached to the case in a single orientation. That is, there is only one orientation of the base 826 that aligns the mounting apertures 856, 858 with installation apertures in the case and enables a bolt or other fastener to pass through the installation apertures in the case and to pass through or engage with the mounting apertures 856, 858. Stated another way, the configuration of the mounting apertures 856, 858 is not symmetric about the centroid 854.

In some embodiments, the non-symmetry of the mounting apertures 856, 858 may be achieved by placement of the mounting apertures 856, 858 at positions relative to the centroid 854. Specifically, an offset line 860 drawn through the center of a first mounting aperture 856 and through the center of a second mounting aperture 858 does not pass through the centroid 854 or does not include the point defined by the centroid 854. That is, the offset line 860 defined by the first and second mounting apertures 856, 858 is offset from the centroid 854. Accordingly, only one orientation of the base 826 relative to a case will allow for installation of the base 826 into the case and fasteners to attach or connect the base 826 to the case.

As shown in FIG. 8C, an enlarged detail of the orientation of lines relative to the centroid 854 is shown. The offset line 860 that is drawn through the center of a first mounting aperture 856 and through the center of a second mounting aperture 858 does not pass through the centroid 854. As such, the offset line 860 has an offset 862 from the centroid 854, with the offset 862 be a shortest distance between the offset line 860 and the centroid 854 (i.e., a line drawn from the centroid 854 to the offset line 860 that is normal or intersects at 90° with the offset line 860). The offset 862 is some non-zero value or distance. In some embodiments, the offset 862 may be 1/10 of an inch or less (0.254 cm or less). Further, in some embodiments, the offset 862 may be 1/20 of an inch or less (0.127 cm or less). In other embodiments, the offset 862 may be greater than 1/10 of an inch (0.254 cm or less).

It will be appreciated that the presently described offset of the mounting apertures on a base of a borescope plug may be applied to any given geometry of the base. For example, turning to FIGS. 9-11, various illustrative and example geometries for the shape of the base of a borescope plug are shown. Although a specific number of example geometries are shown in FIGS. 9-11, those of skill in the art will appreciate that the bases of the present disclosure may take any geometry, including, but not limited to, square shaped, rectangular shaped, circular shaped, triangular shaped, and polygon shaped.

Figure 9:
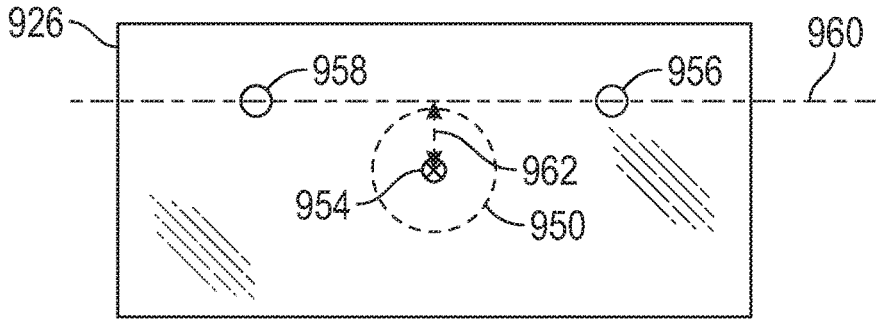
FIG. 9 illustrates a borescope plug base in accordance with an embodiment of the present disclosure having a rectangular geometry with a centroid in the middle thereof.

FIG. 9 illustrates a base 926 having a rectangular geometry with a centroid 954 in the middle thereof. On a side opposite the side illustrated is a boss 950 that engages with, connects to, or otherwise supports a shank as shown and described above. As shown, an offset line 960 is defined by a first mounting aperture 956 and a second mounting aperture 958. The offset line 960 is offset from the centroid 954 by an offset 962.

Figure 10:
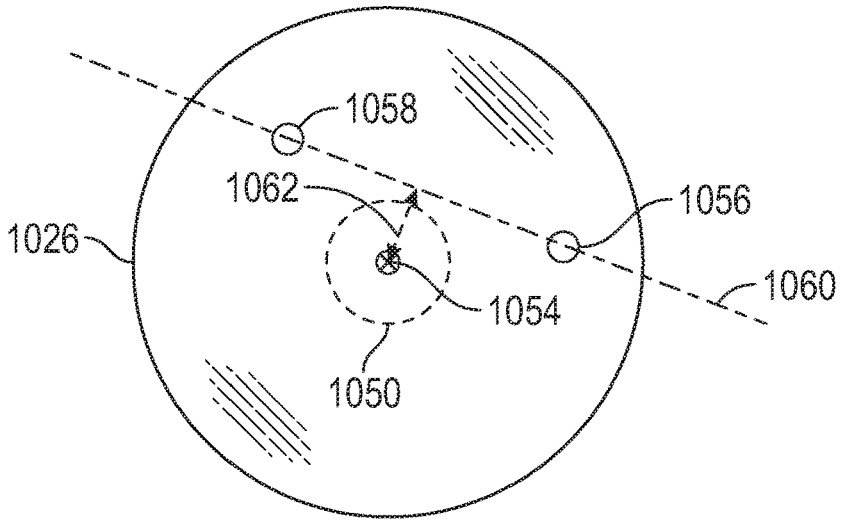
FIG. 10 illustrates a borescope plug base in accordance with an embodiment of the present disclosure having a circular geometry with a centroid in the middle thereof.

FIG. 10 illustrates a base 1026 having a circular geometry with a centroid 1054 in the middle thereof. On a side opposite the side illustrated is a boss 1050 that engages with, connects to, or otherwise supports a shank as shown and described above. As shown, an offset line 1060 is defined by a first mounting aperture 1056 and a second mounting aperture 1058. The offset line 1060 is offset from the centroid 1054 by an offset 1062.

Figure 11:
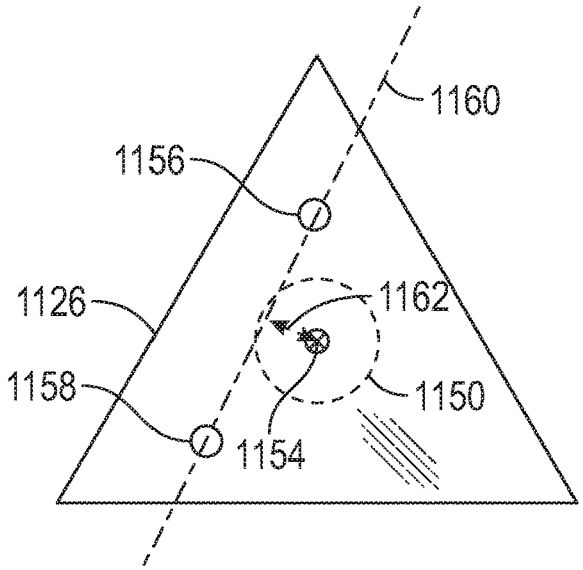
FIG. 11 illustrates a borescope plug base in accordance with an embodiment of the present disclosure having a triangular geometry with a centroid in the middle thereof.

FIG. 11 illustrates a base 1126 having a triangular geometry with a centroid 1154 in the middle thereof. On a side opposite the side illustrated is a boss 1150 that engages with, connects to, or otherwise supports a shank as shown and described above. As shown in this embodiment, an offset line 1160 is defined by a first mounting aperture 1156 and a second mounting aperture 1158. The offset line 1160 is offset from the centroid 1154 by an offset 1162.

Figure 12:
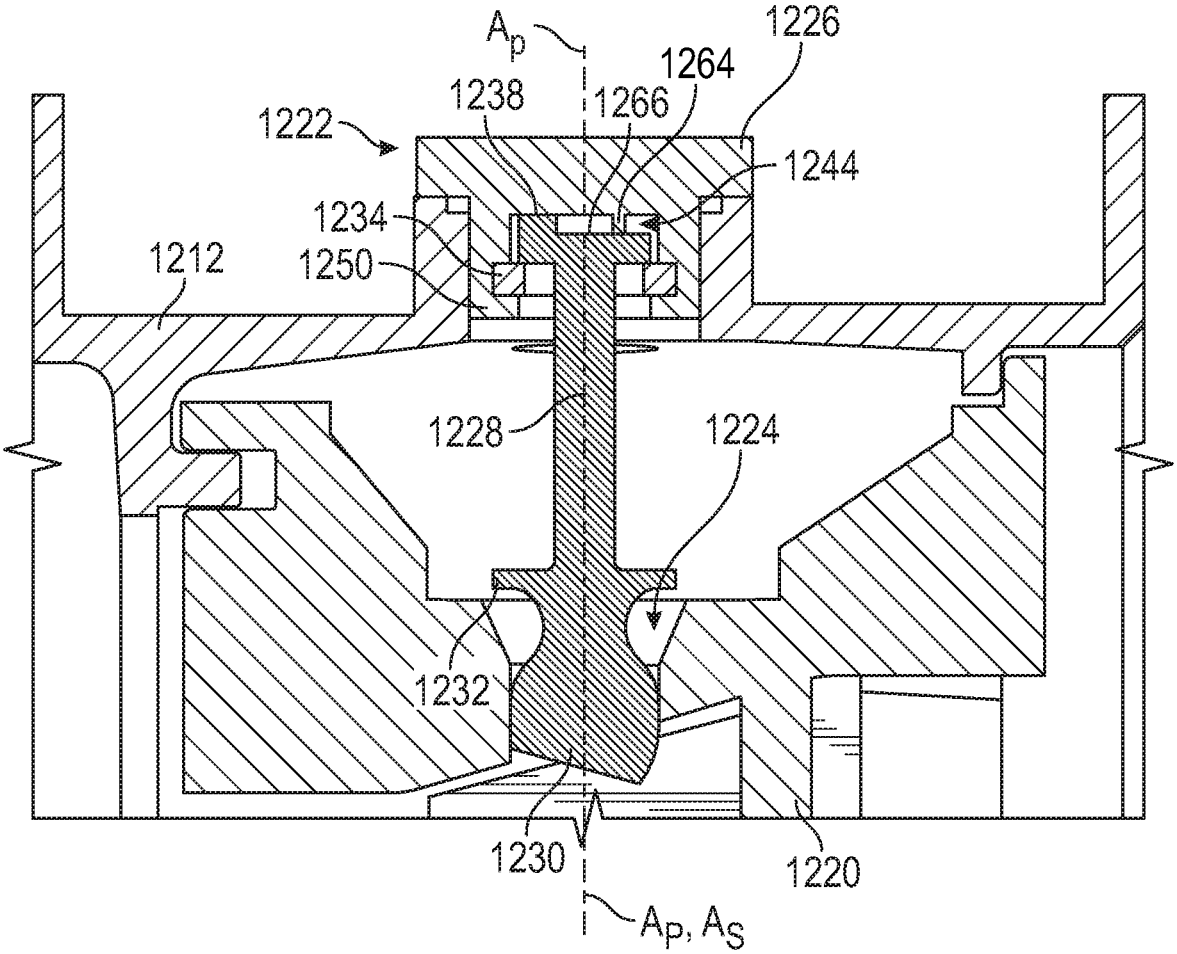
FIG. 12 is a cross-sectional illustration of a borescope plug in accordance with an embodiment of the present disclosure as installed into a case and plugging or engaged with and into a borescope aperture of a borescope vane cluster.

Turning now to FIG. 12, an example non-limiting embodiment of a borescope plug 1222 in accordance with the present disclosure is shown. FIG. 12 is a cross-sectional illustration of the borescope plug 1222 as installed into a case 1212 and plugging or engaged with and into a borescope aperture 1224 of a borescope vane cluster 1220. FIG. 12 illustrates of a connection between a base engagement element 1238 and a boss 1250 of the base 1226 of the borescope plug 1222.

As shown, the borescope plug 1222 includes a base 1226, a shank 1228, and a plug member 1230. In this embodiments, the base 1226 and the shank 1228 are separate elements that are connected together at the base cavity 1244, as described above. Accordingly, the shank 1228, and thus the plug member 1230, can move relative to the base 1226. The base 1226 is fixedly attached or otherwise connected to the case 1212, e.g., through mounting apertures as described above, and the plug member 1230 and shank 1228 can move relative thereto.

The shank 1228 has a base engagement element 1238 at a first end of the shank 1228 and the plug member 1230 is at a second (opposite) end of the shank 1228. The shank 1228 further includes an optional flange 1232, similar to that described above, located at the second end of the shank 1228 between the shank 1228 and the plug member 1230.

In this embodiment, as described above, a retainer 1234 is arranged about a portion of the shank 1228 and maintains the shank 1228 within the base cavity 1244, while allowing the shank 1228 and plug member 1230 to rotate about a plug axis $A_p$. The retainer 434 has a retainer aperture 442 that is wide enough to enable the shank 428 to pass therethrough and also enable movement of the shank 428 within the retainer aperture 442. However, the retainer aperture 442 has a smaller diameter or shape than a diameter or shape of the base engagement element 438. The base engagement element 438 fits within a base cavity 444 of the base 426 that is configured to receive the base engagement element 438. The base engagement element 438 is sized to be smaller than the base cavity 444 such that the shank 428 can rotate about the shank axis $A_s$. It is noted that the plug axis $A_p$ and the shank axis $A_s$ are the same axis in these illustrations.

The base engagement element 1238 is sized such that some amount of movement of the base engagement element 1238 within the base cavity 1244 is possible. Accordingly, in addition to rotational movement about the shank axis A, the base engagement element 1238 is enabled to move laterally or in a plane perpendicular to the shank axis A, or at least have some amount of freedom of movement. In some configurations, the base engagement element 1238 can translate across a plane parallel to a surface of the base 1226. Similar to that described above, because the shank 1228 can rotate, the plug member 1230 has a round geometry such that the same shape of the plug member 1230 always extends into a flow path of the borescope vane cluster 1220.

In this embodiment, the anti-rotation of the shank 1228 and plug member 1230 is configured with a pin as a first anti-rotation element 1264. The anti-rotation elements are provided in the engagement between the base engagement element 1238 and the base 1226 (e.g., with the boss 1250 of the base 1226). The base 1226 includes a first anti-rotation element 1264 and the base engagement element 1238 includes a second anti-rotation element 1266 (e.g., a slot configuration such as shown in FIG. 5D and described above). The anti-rotation elements are configured to operate together to prevent rotation of the shank 1228 relative to the base 1226. As shown, the first anti-rotation element 1264 on the base 1226 is located within the base cavity 1244 and is formed as a protrusion, such as pin-type configuration. The second anti-rotation element of the base engagement element 1238 is a recess, as described above that is sized and shaped to receive the first anti-rotation element 1264. In this embodiment, and described further below, the first anti-rotation element 1264 is a pin or other similar structure that is fixed relative to the boss 1250 of the base 1226 and set offset from an axis or centerline A of the shank 1228 in order to prevent and/or control rotation of the shank 1228 relative to the base 1226.

Figure 13:
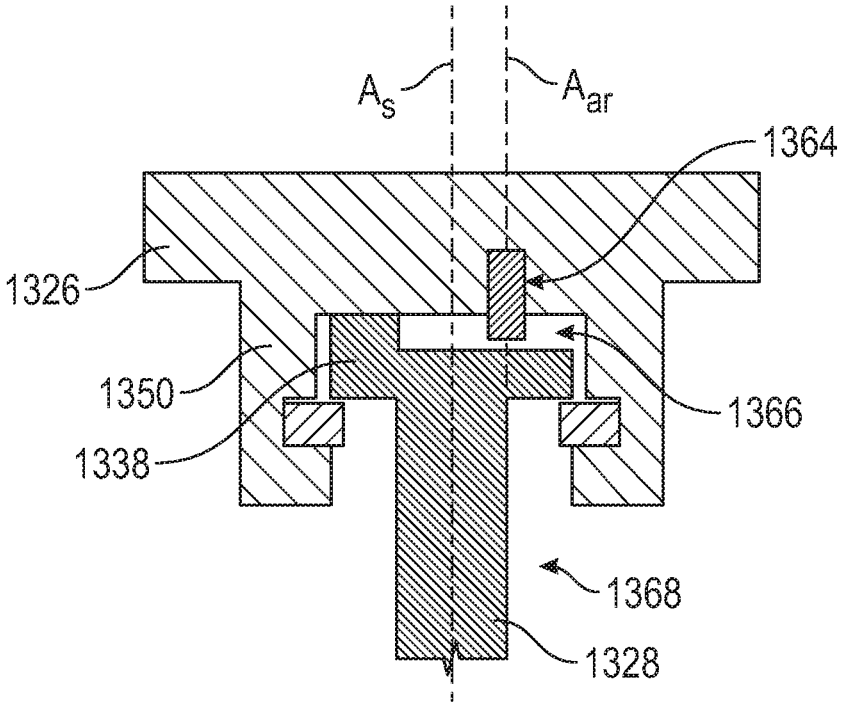
FIG. 13 is an enlarged illustration of an engagement of a shank with a base in accordance with an embodiment of the present disclosure.

Turning now to FIG. 13, an enlarged illustration of an engagement of a shank 1328 with a base 1326 in accordance with an embodiment of the present disclosure is shown. In this embodiment, the base 1326 has a boss 1350 with a first anti-rotation element 1364 in the form of a pin or dowel. The shank 1328 includes a base engagement element 1338 defining a second anti-rotation element 1366, in the form of a slot, recess, or groove. The first anti-rotation element 1364 is positioned within the boss 1350 at a location that is offset from a shank axis $A_s$. Specifically, as shown, an anti-rotation axis $A_{ar}$ is set so that it is parallel with, but offset from, the shank axis $A_s$. In some embodiments, and as shown in FIG. 13, the anti-rotation axis $A_{ar}$ is aligned with an outer radius (or surface) 1368 of the shank 1328. The position of the first anti-rotation element 1364 is set so that the shank 1328 is unable to rotate relative to the base 1326, although some amount of movement is permitted. That is, in some embodiments, the first anti-rotation element 1364 does not form an interference or tight fit with the second anti-rotation element 1366. In some embodiments, rather than a slot configuration for the second anti-rotation element 1366, the second anti-rotation element 1366 may be a round hole or aperture that receives the first anti-rotation element 1364, but no interference tight fit is provided, thus allowing some amount of relative movement of the shank 1328 relative to the base 1326.

Figure 14:
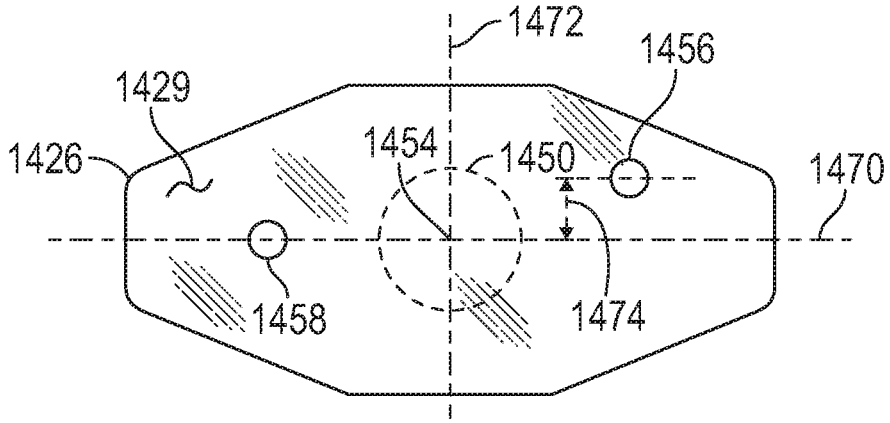
FIG. 14 is a schematic illustration of a base of a borescope plug in accordance with an embodiment of the present disclosure.

Turning now to FIG. 14, a schematic illustration of a base 1426 for a borescope plug is shown. The base 1426 includes a first side (e.g. as shown in FIG. 8A) and a boss 1450 and a second side 1429. In this embodiment, the boss 1450 is integrally formed with the base 826 and thus a boss aperture (described above) is omitted. However, even without the boss aperture, the base 1426 has a center or centroid 1454. The centroid 1454 is the geometric center of the base 1426 and is the arithmetic mean ("average") position of all the points in the shape of the base 1426. In this embodiment, the base 1426 has a major axis 1470 and a minor axis 1472, related to the geometric shape of the base 1426, as will be appreciated by those of skill in the art. Although the base 1426 is shown with a particular geometry (e.g., octagonal), various other geometric shapes may have major and minor axes (e.g., rectangles, ovals, ellipses, etc.), and the present description is not limited to the particular geometric shape shown in FIG. 14.

The base 1426 includes two mounting apertures 1456, 1458 that are configured to enable fixed mounting of the base 1426 to a case of a gas turbine engine. The mounting apertures 1456, 1458 are formed in the second side 1429 of the base 1426 and may pass completely through the base 1426 or may extend only a portion of the way through the base 1426. The mounting apertures 1456, 1458 may be threaded to receive and engage with a fastener to enable mounting of the base to a case of a gas turbine engine. In other embodiments, the mounting apertures 1456, 1458 may be smooth and allow for a fastener to pass therethrough, with the fastener engaging with a nut or other locking element that is positioned on the first side of the base 1426.

The position of the mounting apertures 1456, 1458 is set such that the base 1426 can only be installed into and attached to the case in a single orientation. That is, there is only one orientation of the base 1426 that aligns the mounting apertures 1456, 1458 with installation apertures in the case and enables a bolt or other fastener to pass through the installation apertures in the case and to pass through or engage with the mounting apertures 1456, 1458. Stated another way, the configuration of the mounting apertures 1456, 1458 is not symmetric about at least one of the major axis 1470 or minor axis 1472.

In some embodiments, the non-symmetry of the mounting apertures 1456, 1458 may be achieved by placement of the mounting apertures 1456, 1458 at positions relative to the axes 1470, 1472. In this illustrative embodiment, a first mounting aperture 1456 is offset from the major axis 1470 by an offset distance 1474. Further, a second mounting aperture 1458 is positioned on the major axis 1470. Although the distance from the respective mounting apertures 1456, 1458 to the minor axis 1472 may be the same, the offset distance 1474 enables only a single configuration/orientation of the base 1426 to be installed into a case of a gas turbine engine. In some embodiments, the offset distance 1474 may be 1/10 of an inch or less (0.254 cm or less). Further, although shown with the second mounting aperture 1458 located on the major axis 1470, such configuration is not to be limiting, as the second mounting aperture may be offset from the major axis by a different offset distance, or with the same offset distance, but symmetric over the minor axis, such that only a single installation orientation is possible.

Figure 15:
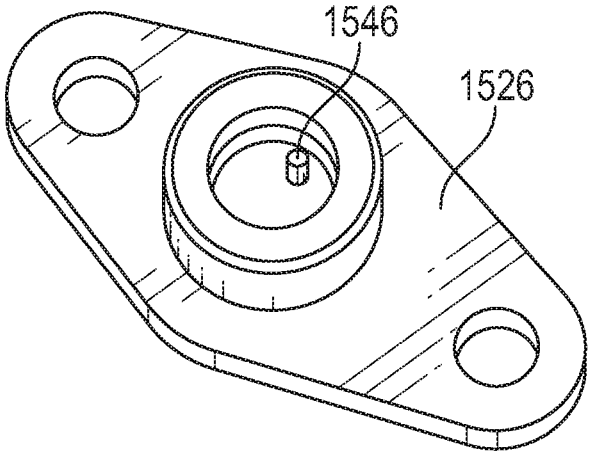
FIG. 15 is a schematic illustration of a base of a borescope plug in accordance with an embodiment of the present disclosure.
Figure 16:
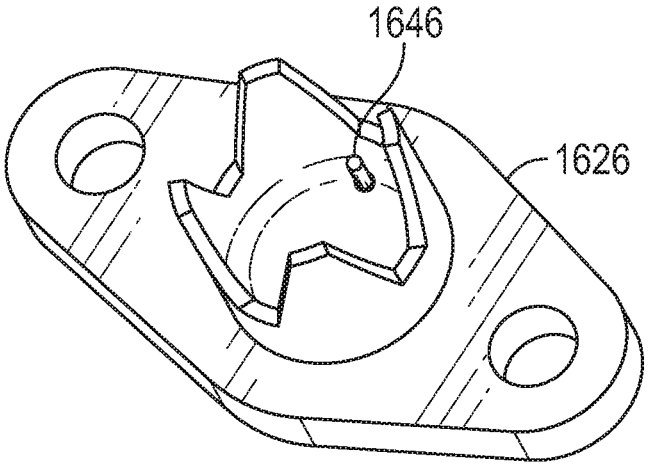
FIG. 16 is a schematic illustration of a base of a borescope plug in accordance with an embodiment of the present disclosure.

Turning now to FIGS. 15-16, schematic illustrations of bases 1526, 1626 of borescope plugs in accordance with embodiments of the present disclosure. FIG. 15 illustrates a base 1526 that is similar in structure to that shown and described with respect to FIG. 5C. However, in this embodiments, an anti-rotation element 1546 within a base cavity is shaped and arranged as a pin, rather than a slot-style configuration. FIG. 16 illustrates a base 1626 that is similar in structure to that shown and described with respect to FIG. 7C. However, in this embodiments, an anti-rotation element 6546 within a base cavity is shaped and arranged as a pin, rather than a slot-style configuration.

FIGS. 15-16 are illustrative of pin configurations for providing anti-rotation. The pin-style anti-rotation elements 1546, 1646 may be insertable into a slot or receiving element of a base engagement element, as shown and described above. For example, the base 1526 may be usable with a base engagement element as shown in FIG. 5D. Similarly, the base 1626 may be useable with a base engagement element as shown in FIG. 7D.

Although shown and described above with respect to certain configurations, orientations, geometries, etc., those of skill in the art will appreciate that variations can be implemented without departing from the scope of the present disclosure. For example, although shown as a circular or semi-spherical, the base engagement element can take any shape or geometry. For example, in some embodiments, the base engagement element can be squared or otherwise include a flat or engaging surface that prevents rotation of the shank while allowing for lateral movement. Further, in embodiments having a rounded or spherical shape, a pin-and-slot configuration may be employed (i.e., a combination of the anti-rotation features of FIGS. 12-13 and the base engagement element of FIGS. 7A-7D).

Further, although described with respect to a borescope plug, those of skill in the art will appreciate that various embodiments and concepts provided herein can be applied to any type of plugging configuration wherein high stresses are possible on a shank of a plug structure.

Advantageously, embodiments described herein provide an improved plug configuration that reduces or eliminate high stresses that are applied to one or more components of the plug. That is, in accordance with some embodiments, stresses applied to and within a plug can be greatly reduced by separating a plug section (e.g., shank and plug member) from a mounting plate (e.g., base). Further, the two-piece separated design of the plugs provides a fixed/pinned arrangement which allows small axial and tangential relative movement between a vane and a base of the plug.

Further, advantageously, embodiments of the present disclosure may improve installation efficiency by only allowing for a single installation orientation of the base of the borescope plug to a case of a gas turbine engine. The offset holes of embodiments of the present disclosure may prevent installing the borescope upside down (specifically the orientation of the plug extending into the gas path). If the plug is installed upside down, the plug would not seal the gas path air and embodiment described herein prevent such installation. Further, advantageously, the pin configuration for anti-rotation reduces the likelihood of binding of the shank to the base and such configuration may be less costly and easy to manufacture as compared to other configurations. Moreover, advantageously, embodiments described herein may prevent borescope plug breakage, ensure proper installation and sealing, prevent fractures and thermal and mechanical mismatch between the outer case hole and inner flow guide/flow path hole.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although an aero or aircraft engine application is shown and described above, those of skill in the art will appreciate that borescope configurations as described herein may be applied to industrial applications and/or industrial gas turbine engines, land based or otherwise. Accordingly, the present disclosure is not to be seen as limited by the foregoing description, but is only limited by the scope of the appended claims.

What is claimed is:

1. A borescope plug comprising:

a borescope plug base having a first side configured to support a shank and a second side having a centroid defined as the center of the borescope plug base, wherein the base has an octagonal geometric shape defining a major axis and a minor axis;

a boss on the first side of the borescope plug, the boss defining a circle projected onto the second side and centered on the centroid;

a first mounting aperture formed in the second side; and a second mounting aperture formed in the second side, wherein the first and second mounting apertures are configured to each receive a fastener to mount the borescope plug base to a case, and wherein an offset line drawn through the center of the first mounting aperture and through the center of the second mounting aperture passes through the circle projected to the second side by the boss and does not pass through the centroid or does not include a point defined by the centroid, wherein the first mounting aperture is positioned such that the major axis passes through the first mounting aperture and the minor axis does not pass through the first mounting aperture, and wherein the second mounting aperture is positioned such that neither the major axis nor the minor axis pass through the second mounting aperture.

2. The borescope plug of claim 1, wherein the offset line has an offset from the centroid being a shortest distance between the offset line and the centroid.

3. The borescope plug of claim 2, wherein the offset is 1/10 inch or less (0.254 cm or less).

4. The borescope plug of claim 1, wherein the boss defines a base cavity.

5. The borescope plug of claim 4, further comprising a first anti-rotation element arranged within the base cavity, the first anti-rotation element configured to be received within a second anti-rotation element of a shank that is installed to the borescope plug base.

6. The borescope plug of claim 5, wherein the first anti-rotation element is a pin.

7. The borescope plug of claim 1, further comprising a shank extending from the boss.

8. The borescope plug of claim 7, wherein the shank is integrally formed with the boss.

9. The borescope plug of claim 7, wherein the shank includes a base engagement element at a first end of the shank and a plug member located at a second end of the shank, the plug member configured to plug a borescope aperture in a borescope vane cluster, wherein the base engagement element fits within a base cavity such that the base moveably retains the base engagement element and wherein the base engagement element can move within the base cavity.

10. The borescope plug of claim 9, further comprising:

a first anti-rotation element arranged within a base cavity of the borescope plug base; and a second anti-rotation element arranged as part of the base engagement element, wherein the first anti-rotation element is configured to be received within the second anti-rotation element.

11. The borescope plug of claim 9, wherein the first anti-rotation element is positioned within the base cavity relative to the shank such that the position of the first anti-rotation element is aligned with an outer surface or an outer radius of the shank.

12. The borescope plug of claim 1, wherein the borescope plug comprises only two mounting apertures.

13. A borescope plug comprising:

a borescope plug base having a first side configured to support a shank and a second side having a major axis and a minor axis passing through a center of the second side of the borescope plug base, wherein the borescope plug base has an octagonal geometric shape that is symmetric about the major axis and symmetric about the minor axis and wherein dimensions of the borescope plug base along the major axis and the minor axis are not equal;

a first mounting aperture formed in the second side; and a second mounting aperture formed in the second side, wherein the first and second mounting apertures are configured to each receive a fastener to mount the borescope plug base to a case, and wherein the first mounting aperture is positioned an offset distance from the major axis and the first and second mounting apertures are not symmetric about the minor axis, wherein the first mounting aperture is positioned such that the major axis passes through the first mounting aperture and the minor axis does not pass through the first mounting aperture, and wherein the second mounting aperture is positioned such that neither the major axis nor the minor axis pass through the second mounting aperture.

14. The borescope plug of claim 13, further comprising a first anti-rotation element arranged on the first side of the borescope plug base, the first anti-rotation element configured to be received within a second anti-rotation element of a shank that is installed to the borescope plug base, wherein the first anti-rotation element is a pin.

15. The borescope plug of claim 13, wherein the offset distance is 1/10 inch or less (0.254 cm or less).

16. The borescope plug of claim 13, wherein the borescope plug comprises only two mounting apertures.

17. A gas turbine engine comprising:

a case having a case aperture;

a borescope vane cluster installed on an inner diameter of the case proximate the case aperture and having a borescope aperture; and a borescope plug comprising:

a base fixedly attached to the case and having a first side and a second side, the second side having a centroid defined as the center of the borescope plug base, wherein the base has an octagonal geometric shape defining a major axis and a minor axis;

a boss on the first side of the borescope plug, the boss defining a circle projected onto the second side and centered on the centroid;

a first mounting aperture formed in the second side; and a second mounting aperture formed in the second side;

wherein the first and second mounting apertures are configured to each receive a fastener to mount the borescope plug base to the case, and wherein an offset line drawn through the center of the first mounting aperture and through the center of the second mounting aperture passes through the circle projected to the second side by the boss and does not pass through the centroid or does not include a point defined by the centroid, wherein the first mounting aperture is positioned such that the major axis passes through the first mounting aperture and the minor axis does not pass through the first mounting aperture, and wherein the second mounting aperture is positioned such that neither the major axis nor the minor axis pass through the second mounting aperture.

18. The gas turbine engine of claim 17, further comprising:

a shank extending from the boss, wherein the shank includes a base engagement element at a first end of the shank and a plug member located at a second end of the shank, the plug member configured to plug a borescope aperture in a borescope vane cluster, wherein the base engagement element fits within a base cavity such that the base moveably retains the base engagement element and wherein the base engagement element can move within the base cavity.

19. The gas turbine engine of claim 18, further comprising:

a first anti-rotation element arranged within the base cavity; and a second anti-rotation element arranged as part of the base engagement element, wherein the first anti-rotation element is a pin and is configured to be received within the second anti-rotation element.

* * * * *